US012590714B2

(12) United States Patent
Xu et al.

(10) Patent No.: US 12,590,714 B2
(45) Date of Patent: Mar. 31, 2026

(54) AIR CONDITIONER INDOOR UNIT

(71) Applicant: QINGDAO HISENSE HITACHI AIR-CONDITIONING SYSTEMS CO., LTD., Qingdao (CN)

(72) Inventors: Kun Xu, Qingdao (CN); Luhua Yan, Qingdao (CN); Zhichao Yuan, Qingdao (CN); Yanfang Zhu, Qingdao (CN); Hu Li, Qingdao (CN); Tao Li, Qingdao (CN); Jianjun Meng, Qingdao (CN); Bao Qi, Qingdao (CN); Xutong Song, Qingdao (CN); Yanqiang Huan, Qingdao (CN); Changquan Zhang, Qingdao (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 437 days.

(21) Appl. No.: 18/332,827

(22) Filed: Jun. 12, 2023

(65) Prior Publication Data

US 2023/0332775 A1 Oct. 19, 2023

Related U.S. Application Data

(63) Continuation of application No. PCT/CN2022/082611, filed on Mar. 23, 2022.

(30) Foreign Application Priority Data

Mar. 23, 2021 (CN) ..... 202110306263.5
Mar. 23, 2021 (CN) ..... 202110306271.X
(Continued)

(51) Int. Cl.
*F24F 1/0047* (2019.01)
*F24F 13/06* (2006.01)
*F24F 13/10* (2006.01)

(52) U.S. Cl.
CPC ..... *F24F 1/0047* (2019.02); *F24F 13/06* (2013.01); *F24F 13/10* (2013.01)

(58) Field of Classification Search
CPC ..... F24F 1/0047; F24F 2013/1446; F24F 13/084; F24F 13/06; F24F 13/10; F24F 2013/0616
See application file for complete search history.

(56) References Cited

U.S. PATENT DOCUMENTS

2017/0198938 A1 7/2017 Kim et al.
2018/0259217 A1 9/2018 Kojima et al.
(Continued)

FOREIGN PATENT DOCUMENTS

CN 104456895 A 3/2015
CN 105444268 A 3/2016
(Continued)

OTHER PUBLICATIONS

Machine Translation of WO 2019172695 (Year: 2019).*
(Continued)

*Primary Examiner* — Allen R. B. Schult
*Assistant Examiner* — Amy E Carter
(74) *Attorney, Agent, or Firm* — MH2 TECHNOLOGY LAW GROUP LLP

(57) ABSTRACT

An air conditioner indoor unit includes a housing, a panel, a fan assembly, a first air guide assembly, and a first driving assembly. The panel includes a first air outlet. The first air guide assembly is located on a side of the panel away from the housing, and a second air outlet is constituted between an edge of the first air guide assembly and an edge of the first air outlet. The first driving assembly is configured to drive the first air guide assembly to move relative to the panel, so as to change a size of the second air outlet to adjust a flow direction of air flowing out from the second air outlet. The
(Continued)

first air guide assembly includes a flow direction changing structure, and the flow direction changing structure is configured to move in a direction different from a moving direction of the first air guide assembly.

17 Claims, 22 Drawing Sheets

(30) Foreign Application Priority Data

| | | |
|---|---|---|
| Mar. 23, 2021 | (CN) | 202110306272.4 |
| Jun. 15, 2021 | (CN) | 202121324537.5 |
| Jul. 13, 2021 | (CN) | 202110790974.4 |
| Jul. 30, 2021 | (CN) | 202121770385.1 |

(56) References Cited

U.S. PATENT DOCUMENTS

| | | | | |
|---|---|---|---|---|
| 2018/0306452 | A1* | 10/2018 | Kim | F24F 13/12 |
| 2020/0088420 | A1 | 3/2020 | Oh et al. | |

FOREIGN PATENT DOCUMENTS

| | | | | | |
|---|---|---|---|---|---|
| CN | 106168406 | A | | 11/2016 | |
| CN | 106801919 | A | | 6/2017 | |
| CN | 106839089 | A | | 6/2017 | |
| CN | 107023894 | A | | 8/2017 | |
| CN | 107036168 | A | | 8/2017 | |
| CN | 107062573 | A | | 8/2017 | |
| CN | 107143922 | A | | 9/2017 | |
| CN | 107429924 | A | | 12/2017 | |
| CN | 107883458 | A | | 4/2018 | |
| CN | 207501283 | U | | 6/2018 | |
| CN | 108626787 | A | | 10/2018 | |
| CN | 109386879 | A | | 2/2019 | |
| CN | 109386883 | A | | 2/2019 | |
| CN | 109520019 | A | * | 3/2019 | F24F 1/0014 |
| CN | 209558529 | U | | 10/2019 | |
| CN | 209910040 | U | | 1/2020 | |
| CN | 210197470 | U | | 3/2020 | |
| CN | 210345811 | U | | 4/2020 | |
| CN | 111397186 | A | | 7/2020 | |
| CN | 111442381 | A | | 7/2020 | |
| CN | 111509926 | A | | 8/2020 | |
| CN | 111912015 | A | | 11/2020 | |
| CN | 112032837 | A | | 12/2020 | |
| CN | 113028506 | A | | 6/2021 | |
| CN | 113028507 | A | | 6/2021 | |
| CN | 113028508 | A | | 6/2021 | |
| CN | 113587223 | A | | 11/2021 | |
| CN | 215336692 | U | | 12/2021 | |
| CN | 215637561 | U | | 1/2022 | |
| EP | 2466221 | A1 | | 6/2012 | |
| EP | 2899472 | A1 | | 7/2015 | |
| EP | 4024684 | A1 | | 7/2022 | |
| GB | 2015152 | A | | 9/1979 | |
| JP | 2017067354 | A | | 4/2017 | |
| KR | 1020170082745 | A | | 7/2017 | |
| WO | WO 2018167894 | | * | 9/2018 | F24F 13/20 |
| WO | WO-2019172695 | A1 | * | 9/2019 | F24F 13/20 |

OTHER PUBLICATIONS

Machine Translation of CN-109520019 (Year: 2019).*
International Search Report and Written Opinion dated Jun. 16, 2022 in corresponding International Application No. PCT/CN2022/082611, translated, 23 pages.
Chinese First Office Action dated Jan. 10, 2022 in corresponding Chinese Application No. 202110306263.5, translated, 17 pages.
Chinese First Office Action dated Mar. 15, 2022 in corresponding Chinese Application No. 202110306271.X, translated, 19 pages.
Chinese Notification to Grant Patent Right for Invention dated Jul. 5, 2022 in corresponding Chinese Application No. 202110306271.X, translated, 6 pages.
Chinese First Office Action dated Mar. 15, 2022 in corresponding Chinese Application No. 202110306272.4, translated, 18 pages.
Chinese Notification to Grant Patent Right for Invention dated Jul. 5, 2022 in corresponding Chinese Application No. 202110306272.4, translated, 6 pages.
Chinese First Office Action dated May 19, 2022 in corresponding Chinese Application No. 202110790974.4, translated, 16 pages.
Chinese Second Office Action dated Nov. 15, 2022 in corresponding Chinese Application No. 202110790974.4, translated, 14 pages.
Chinese Decision of Rejection dated Feb. 25, 2023 in corresponding Chinese Application No. 202110790974.4, translated, 15 pages.
Chinese First Office Action Jul. 15, 2025 in corresponding Chinese Application No. 202280008878.2, translated, 16 pages.

* cited by examiner

AIR CONDITIONER INDOOR UNIT

CROSS-REFERENCE TO RELATED APPLICATIONS

This application is a continuation Application of International Patent Application No. PCT/ICN2022/082611, filed on Mar. 23, 2022, pending, which claims priorities to Chinese Patent Application No. 202110306263.5, filed on Mar. 23, 2021; Chinese Patent Application No. 202110306271.X, filed on Mar. 23, 2021; Chinese Patent Application No. 202110306272.4, filed on Mar. 23, 2021; Chinese Patent Application No. 202110790974.4, filed on Jul. 13, 2021; Chinese Patent Application No. 202121770385.1, filed on Jul. 30, 2021; and Chinese Patent Application No. 202121324537.5, filed on Jun. 15, 2021, which are incorporated herein by reference in their entireties.

TECHNICAL FIELD

The present disclosure relates to the field of air conditioning technologies, and in particular, to an air conditioner indoor unit.

BACKGROUND

Air conditioners are one of common electrical appliances in family life. With an improvement of living standards of people, people have high requirements for the performance of air conditioners in all aspects. Generally, the air conditioners perform a cooling cycle or a heating cycle of the air conditioners by using a compressor, a condenser, an expansion valve, and an evaporator.

SUMMARY

In an aspect, an air conditioner indoor unit is provided. The air conditioner indoor unit includes a housing, a panel, a fan assembly, a first air guide assembly, and at least one first driving assembly. The housing has an inner cavity, and a side of the inner cavity is open to constitute an opening. The panel is disposed at the opening of the housing, and the panel includes a first air outlet. The fan assembly is located in the inner cavity of the housing. The first air guide assembly is located on a side of the panel away from the housing, and a second air outlet is provided between an edge of the first air guide assembly and an edge of the first air outlet. The second air outlet is a portion of the first air outlet. An end of the first driving assembly is fixedly connected to the panel, and another end of the first driving assembly is fixedly connected to the first air guide assembly. The first driving assembly is configured to drive the first air guide assembly to move relative to the panel, so as to change a size of the second air outlet to adjust a flow direction of air flowing out from the second air outlet. The first air guide assembly includes a flow direction changing structure, and the flow direction changing structure is configured to move in a direction different from a moving direction of the first air guide assembly, so as to change at least a portion of the second air outlet to adjust the flow direction of part or all of the air flowing out from the second air outlet.

In another aspect, an air conditioner indoor unit is provided. The air conditioner indoor unit includes a housing, a panel, a fan assembly, a first air guide assembly, and a plurality of first driving assemblies. The housing has an inner cavity, and a side of the inner cavity is open to constitute an opening. The panel is disposed at the opening of the housing, and the panel includes a first air outlet. The fan assembly is located in the inner cavity of the housing. The first air guide assembly is located on a side of the panel away from the housing, and a second air outlet is provided between an edge of the first air guide assembly and an edge of the first air outlet. The second air outlet is a portion of the first air outlet. An end of at least one of the plurality of first driving assemblies is fixedly connected to the panel, and another end of the first driving assembly is fixedly connected to the first air guide assembly. The first driving assembly includes a rotating member, and the rotating member is configured to make the first air guide assembly rotatable relative to the rotating member. The plurality of first driving assemblies are configured to move synchronously, so as to drive the first air guide assembly to move in a direction away from or proximate to the panel, or to move asynchronously to drive the first air guide assembly to perform a tilting movement relative to the panel, so as to change a size of the second air outlet to adjust a flow direction of air flowing out from the second air outlet.

DETAILED DESCRIPTION

Figure 1:
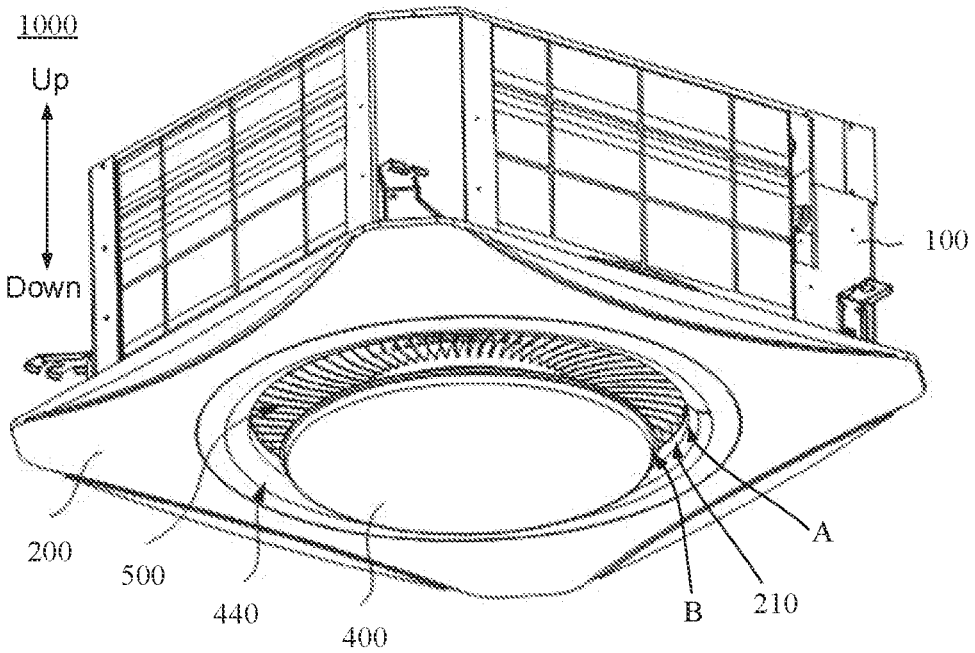
FIG. 1 is a diagram showing a structure of an air conditioner indoor unit, in accordance with some embodiments.

Some embodiments of the present disclosure will be clearly and completely described below with reference to the accompanying drawings. However, the described embodiments are merely some but not all embodiments of the present disclosure. All other embodiments obtained by a person of ordinary skill in the art based on embodiments of the present disclosure shall be included in the protection scope of the present disclosure.

Unless the context requires otherwise, throughout the specification and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment," "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

The use of the phrase "applicable to" or "configured to" herein means an open and inclusive expression, which does not exclude devices that are applicable to or configured to perform additional tasks or steps.

The phrase "at least one of A, B, and C" has the same meaning as the phrase "at least one of A, B, or C", both including the following combinations of A, B, and C: only A, only B, only C, a combination of A and B, a combination of A and C, a combination of B and C, and a combination of A, B, and C.

The phrase "A and/or B" includes the following three combinations: only A, only B, and a combination of A and B.

Hereinafter, the terms such as "first" and "second" are used for descriptive purposes only and are not to be construed as indicating or implying the relative importance or implicitly indicating the number of indicated technical features. Thus, features defined by "first" or "second" may explicitly or implicitly include one or more of the features. In the description of the embodiments of the present disclosure, the term "a plurality of" or "the plurality of" means two or more unless otherwise specified.

In the description of some embodiments, the expression "connected," and derivatives thereof may be used. The term "connected" should be understood in a broad sense. For example, the term "connected" may represent a fixed connection, a detachable connection, or a one-piece connection, or may represent a direct connection, or may represent an indirect connection through an intermediate medium. The embodiments disclosed herein are not necessarily limited to the content herein.

The term such as "about," "substantially," and "approximately" as used herein includes a stated value and an average value within an acceptable range of deviation of a particular value. The acceptable range of deviation is determined by a person of ordinary skill in the art, considering measurement in question and errors associated with measurement of a particular quantity (i.e., limitations of a measurement system).

The term such as "parallel," "perpendicular," or "equal" as used herein includes a stated condition and a condition similar to the stated condition. A range of the similar condition is within an acceptable deviation range, and the acceptable deviation range is determined by a person of ordinary skill in the art, considering measurement in question and errors associated with measurement of a particular quantity (i.e., the limitations of a measurement system). For example, the term "parallel" includes absolute parallelism and approximate parallelism, and an acceptable deviation range of the approximate parallelism may be, for example, a deviation within 5°. The term "perpendicular" includes absolute perpendicularity and approximate perpendicularity, and an acceptable deviation range of the approximate perpendicularity may also be, for example, a deviation within 5°. The term "equal" includes absolute equality and approximate equality, and an acceptable deviation range of the approximate equality may be that, for example, a difference between the two that are equal is less than or equal to 5% of either of the two.

Air conditioners include one-piece air conditioners and split-type air conditioners. In the split-type air conditioners, indoor units may be divided into stand-type indoor units, wall-mounted indoor units, and ceiling-mounted indoor units according to different installation methods of the indoor units. The ceiling-mounted indoor unit has advantages of small occupied space, flexible installation methods, and convenient maintenance, so that the ceiling-mounted indoor unit is suitable for installation in places such as a hotel, a shopping mall, an airport, a hospital, a factory, or a research institute.

Figure 2:
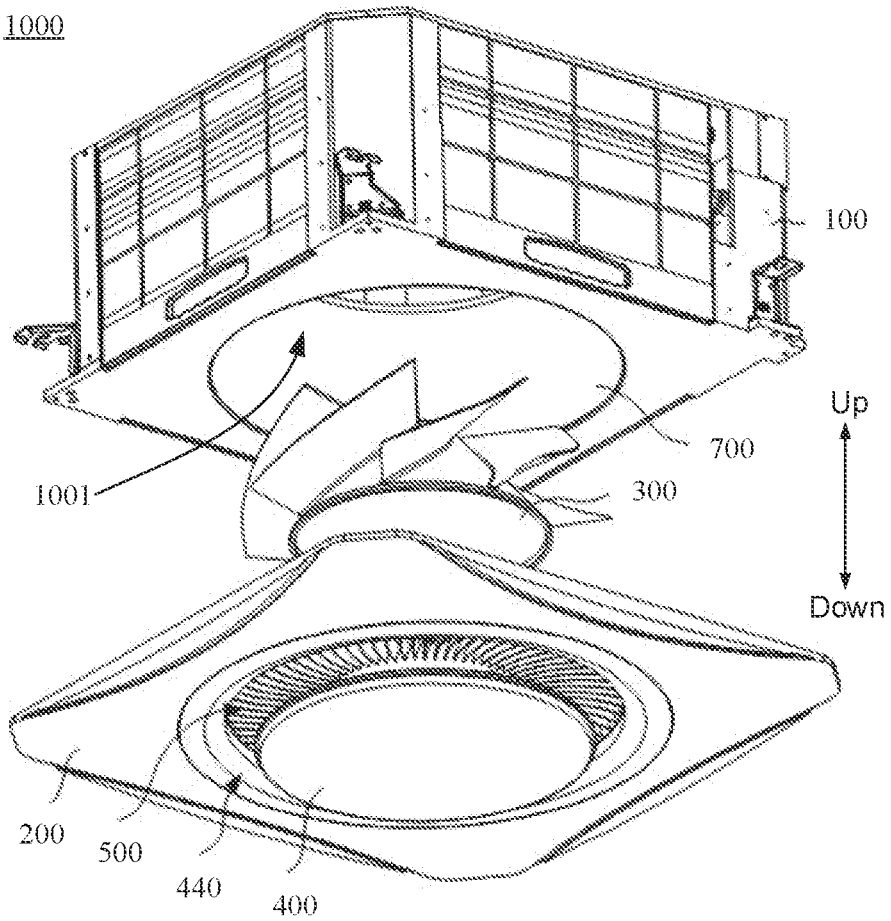
FIG. 2 is an exploded view of the air conditioner indoor unit shown in FIG. 1.

In some embodiments, as shown in FIGS. 1 and 2, an air conditioner indoor unit 1000 is the ceiling-mounted indoor unit and includes a housing 100, a panel 200, a fan assembly 300, a first air guide assembly 400, and a second air guide assembly 500.

The housing 100 includes four side walls and an inner cavity 1001 surrounded by the four side walls. The inner cavity 1001 is configured to accommodate the fan assembly 300 and an indoor heat exchanger. A side (e.g., the lower side) of the housing 100 is opened to form an opening, and the panel 200 is disposed at the opening. The panel 200 includes a first air outlet 210. The first air outlet 210 in a shape of a ring. Of course, in some embodiments, the first air outlet 210 may also be in a rectangular shape or in a shape of other polygons, which depends on actual design cases.

Figure 3:
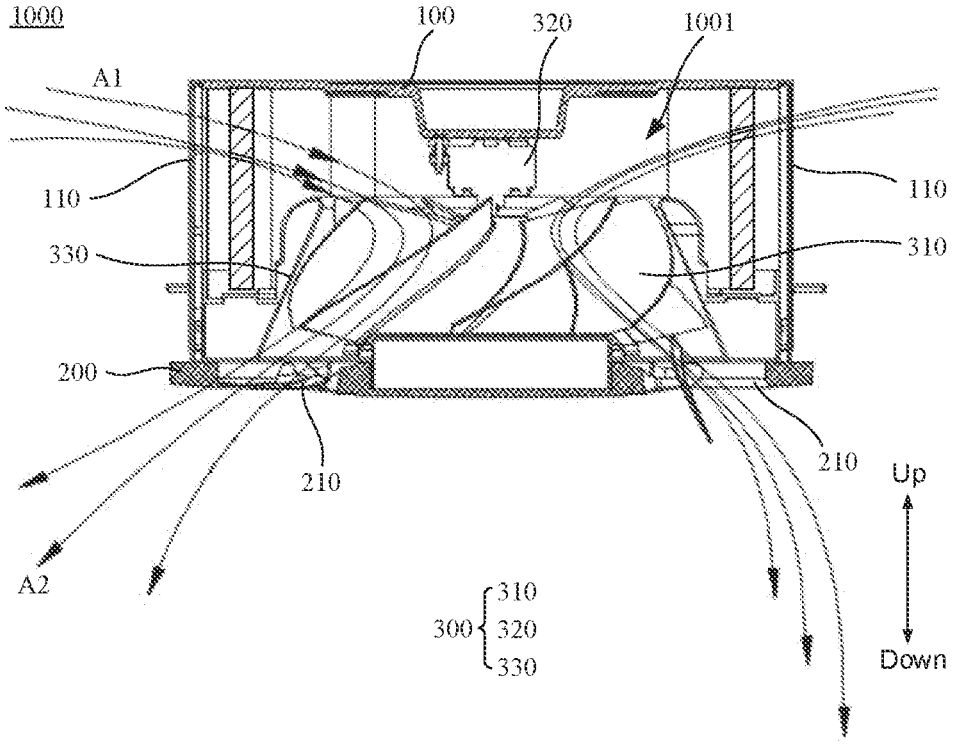
FIG. 3 is a schematic diagram of an air flow path between a return air inlet and a first air outlet, in accordance with some embodiments.

As shown in FIG. 3, the housing 100 further includes a return air inlet 110, and the return air inlet 110 is located on the side wall of the housing 100. In a case where the fan assembly 300 is disposed in the housing 100, the fan assembly 300 drives air (e.g., indoor air) to enter the air conditioner indoor unit 1000 through the return air inlet 110, and the air entering the air conditioner indoor unit 1000 flows out from the first air outlet 210 after exchanging heat with the indoor heat exchanger. In order to improve the cleanliness of the air entering the air conditioner indoor unit 1000, the housing 100 further includes a filter mesh, and the filter mesh is disposed at the return air inlet 110.

As shown in FIG. 3, in a case where the return air inlet 110 is located on the side wall of the housing 100, the return air inlet 110 and the first air outlet 210 are located on different planes, so that an air flow path in the air conditioner indoor unit 1000 substantially has a shape of a letter of "C," and a return air flow path (e.g., the direction shown by the arrow A1 in FIG. 3) and an air outlet flow path (e.g., the direction shown by the arrow A2 in FIG. 3) of the air flow path do not affect each other.

Figure 4:
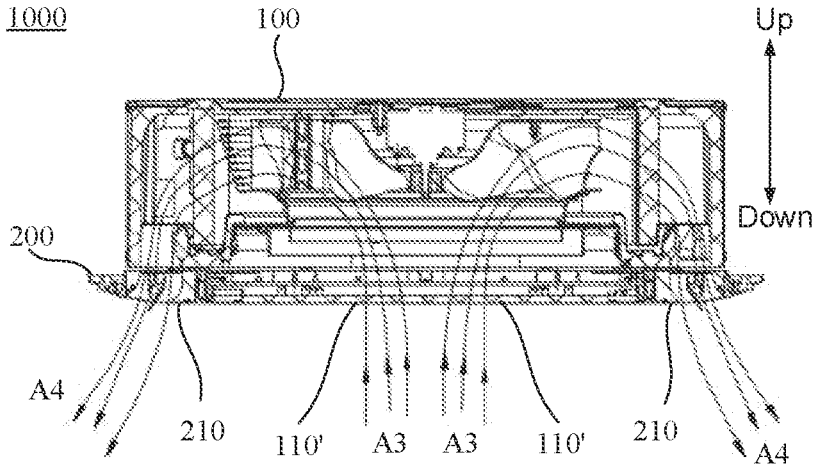
FIG. 4 is a schematic diagram of an air flow path between a return air inlet and a first air outlet in the related art.

In some embodiments, the first air outlet 210 and a return air inlet 110' are located on a same plane. For example, as shown in FIG. 4, the panel 200 includes the first air outlet 210 and the return air inlet 110'. In this case, the first air outlet 210 and the return air inlet 110' are located on a same plane, and the air flow path in the air conditioner indoor unit 1000 substantially has a shape of a letter of "U," and the return air flow path (e.g., the direction shown by the arrow A3 in FIG. 4) and the air outlet flow path (e.g., the direction shown by the arrow A4 in FIG. 4) in the air flow path are likely to interfere with each other, which increases the resistance of the air in the return air flow path. However, in the air conditioner indoor unit 1000 provided in some embodiments of the present disclosure, the return air inlet 110 and the first air outlet 210 are arranged on different planes. During the operation of the ceiling-mounted air conditioner indoor unit 1000, the air flows from a high place to a low place, so that the flow resistance of the air may be reduced, and the noise of the fan assembly 300 caused by the flow resistance may also be reduced.

In order to clearly show the aft flow path between the return air inlet 110 and the first air outlet 210 and the air flow path between the return air inlet 110' and the first air outlet 210, some components such as the first air guide assembly 400 and the second air guide assembly 500 are not shown in FIGS. 3 and 4.

As shown in FIG. 3, the fan assembly 300 includes a fan 310, a fan motor 320, and a fan shroud 330.

The fan motor 320 is fixedly connected to the housing 100 and is configured to drive the fan 310 to operate.

The fan 310 is configured to draw indoor air into the air conditioner indoor unit 1000 through the return air inlet 110 and exhaust the indoor air after exchanging heat with the indoor heat exchanger through the first air outlet 210. The fan 310 provides power for the flow of the indoor air. The fan assembly 300 includes a diagonal flow fan, which may make the air at the first air outlet 210 do centrifugal and axial movements, so that the air may flow to multiple corners of the indoor, so as to make the air output of the air conditioner indoor unit 1000 uniform.

The fan shroud 330 is disposed in the inner cavity 1001 of the housing 100 and is located outside of the fan 310. The fan shroud 330 is configured to guide airflow generated by the fan 310 to the first air outlet 210. An end portion (e.g., the bottom portion) of the fan shroud 330 proximate to the first air outlet 210 is opposite to an edge A (as shown in FIGS. 1 and 5A) of the first air outlet 210.

Figure 5A:
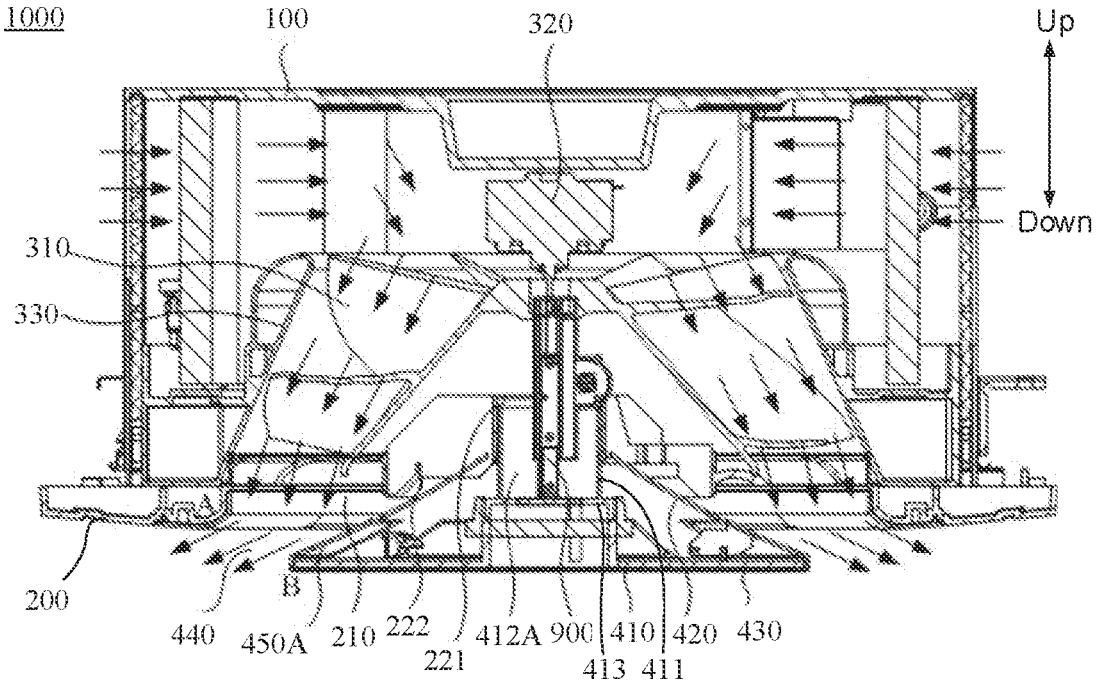
FIG. 5A is a sectional view of an air conditioner indoor unit in a first blowing mode, in accordance with some embodiments.

As shown in FIGS. 1, 2, and 5A, the first air guide assembly 400 is mounted on the panel 200 and is located on a side of the panel 200 away from the housing 100. The first air guide assembly 400 is configured to control a flow direction of the air flowing out from the first air outlet 210. A second air outlet 440 is formed between the edge A of the first air outlet 210 and an edge B of the first air guide assembly 400. The second air outlet 440 is in a shape of a ring and is a portion of the first air outlet 210. The air flowing out from the first air outlet 210 flows out through the second air outlet 440.

The first air guide assembly 400 may move in a direction proximate to or away from the panel 200, so that the air conditioner indoor unit 1000 provided in some embodiments of the present disclosure may achieve three blowing modes through the first air guide assembly 400. The first is a first blowing mode. In the first blowing mode, the air flowing out from the second air outlet 440 flows in an approximately horizontal direction, and then the air flowing in the horizontal direction flows downwards from the top of the room, so as to achieve the effect of cold air (or hot air) sinking. The second is a second blowing mode. In the second blowing mode, the air flowing out from the second air outlet 440 flows downwards in an approximately vertical direction, and the flow direction of the air is similar to that of a waterfall. The third is a third blowing mode. In the third blowing mode, the blowing mode of the air conditioner indoor unit 1000 is switched between the first blowing mode and the second blowing mode, so that the air flowing out from the second air outlet 440 may simulate natural wind.

Figure 6A:
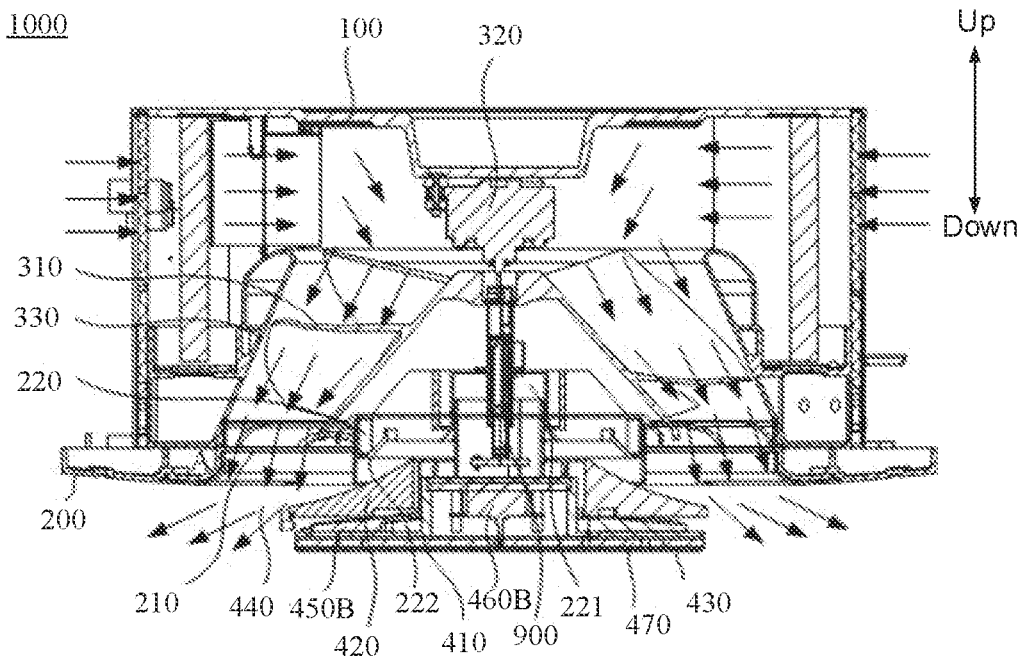
FIG. 6A is a sectional view of another air conditioner indoor unit in a first blowing mode, in accordance with some embodiments.
Figure 7A:
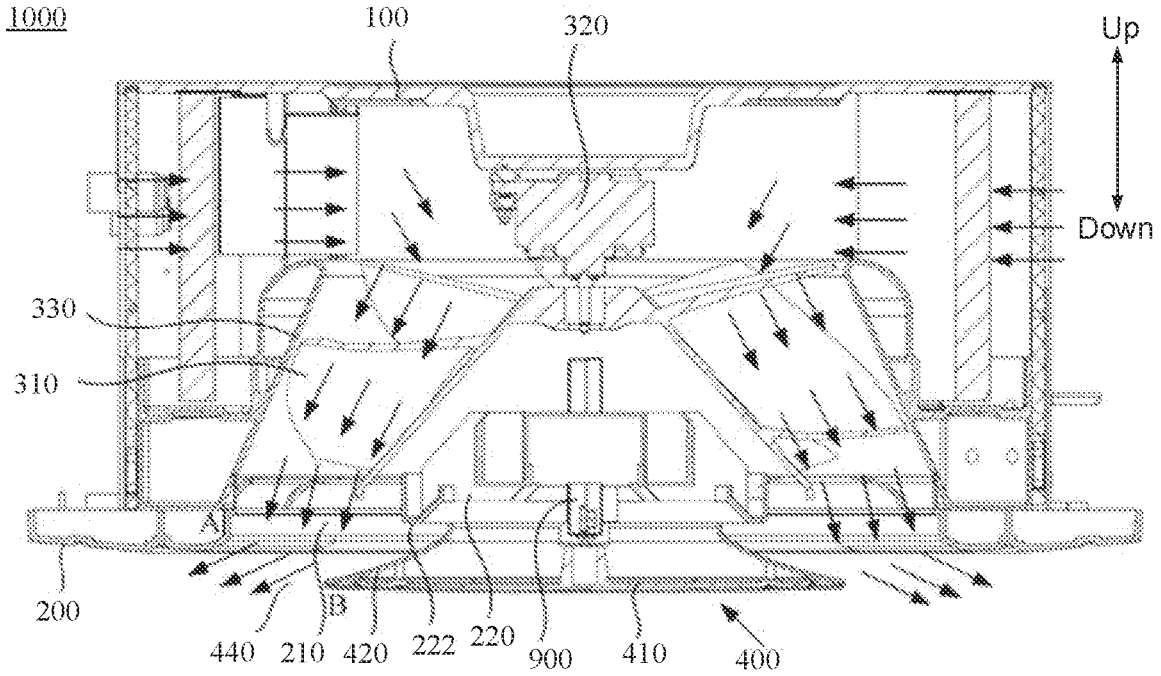
FIG. 7A is a sectional view of yet another air conditioner indoor unit in a first blowing mode, in accordance with some embodiments.

For example, as shown in FIGS. 5A, 6A, and 7A, in a case where the first air guide assembly 400 moves (e.g., upwards) to a first extreme position in the direction proximate to the panel 200, the edge B of the first air guide assembly 400 is closest to edge A of the first air outlet 210. In this case, a size of the second air outlet 440 is the smallest, and the air flows out from the second air outlet 440 in the approximately horizontal direction, so that the air may flow out in the approximately horizontal direction. Since the air conditioner indoor unit 1000 is located on the top of the room, the air flowing out in the horizontal direction may slowly flow downwards, so as to achieve the effect of the cold air (or the hot air) sinking, thereby achieving the first blowing mode.

The first blowing mode may prevent the cold air (or the hot air) from blowing directly to the users, so as to achieve the effect of not feeling the air blowing and uniform air supply.

Figure 5B:
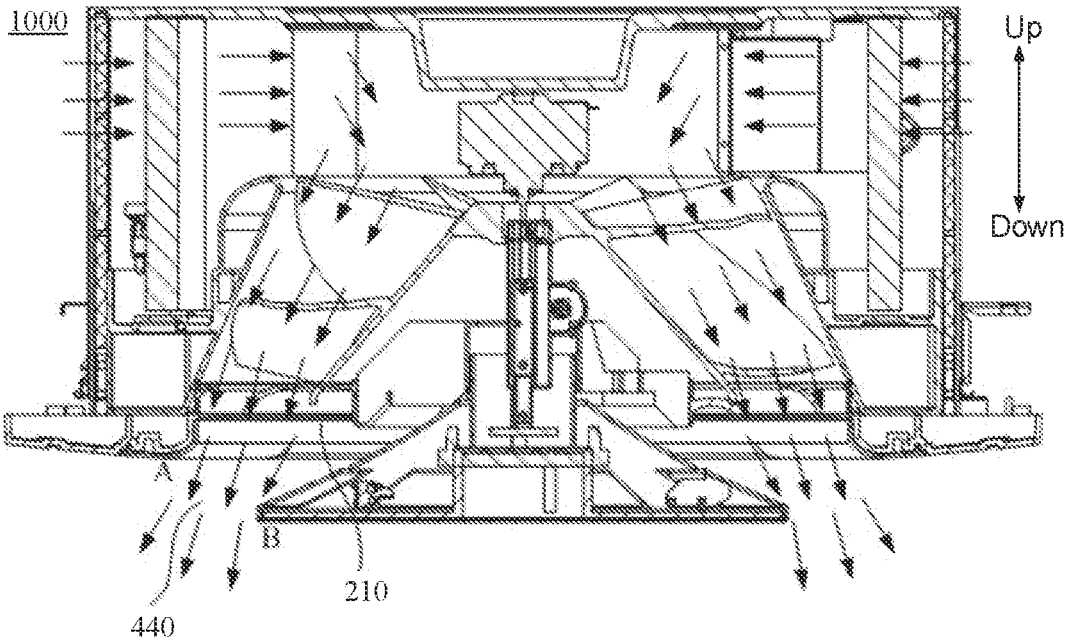
FIG. 5B is a sectional view of an air conditioner indoor unit in a second blowing mode, in accordance with some embodiments.
Figure 6B:
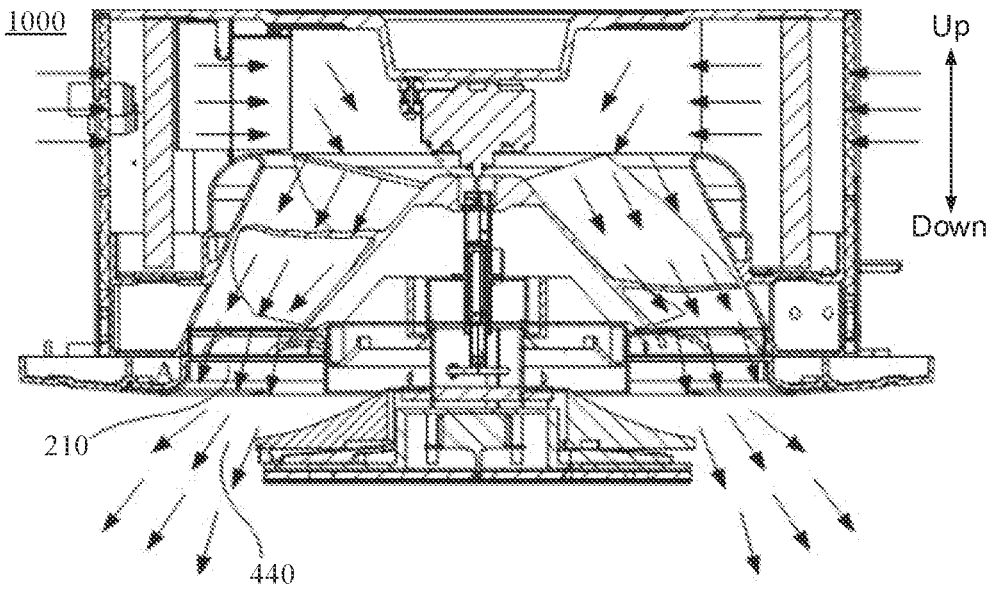
FIG. 6B is a sectional view of another air conditioner indoor unit in a second blowing mode, in accordance with some embodiments.
Figure 7B:
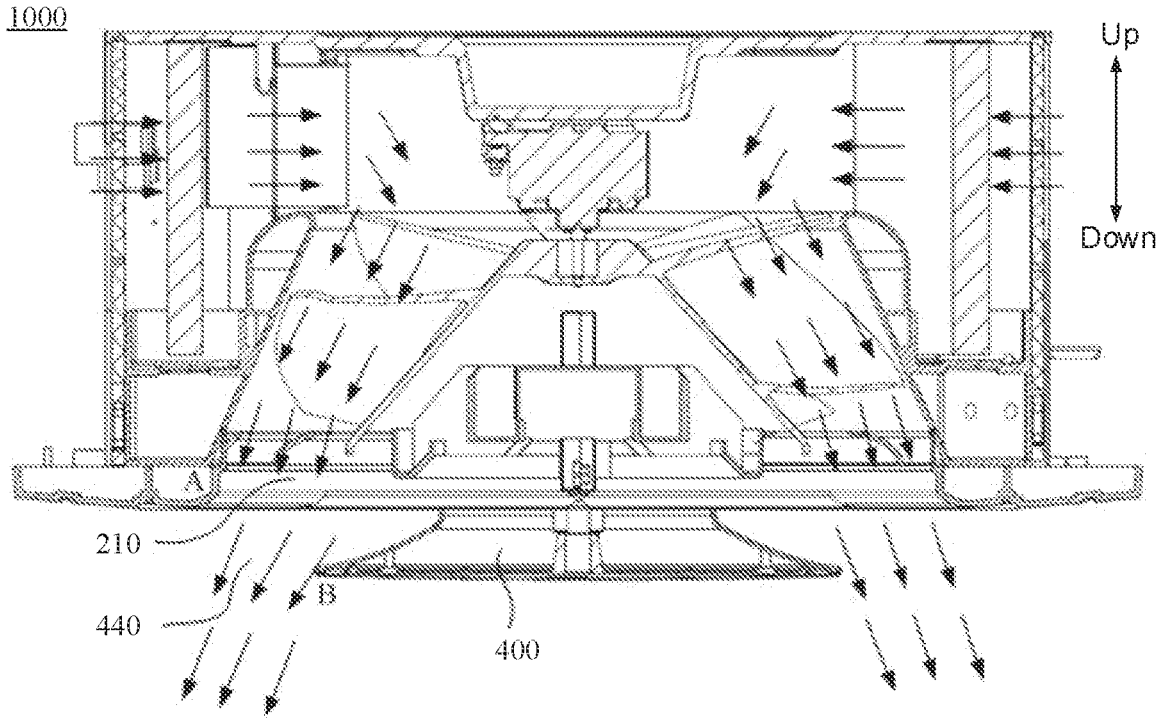
FIG. 7B is a sectional view of yet another air conditioner indoor unit in a second blowing mode, in accordance with some embodiments.

As shown in FIGS. 5B, 6B, and 7B, in a case where the first air guide assembly 400 moves (e.g., downwards) to a second extreme position in the direction away from the panel 200, the edge B of the first air guide assembly 400 is farthest from the edge A of the first air outlet 210. In this case, the size of the second air outlet 440 is the largest, and the air flows out from the second air outlet 440 in the approximately vertical direction, so that the air may flow downwards in the approximately vertical direction, thereby achieving the second blowing mode.

The second blowing mode may make the cold air (or the hot air) blow directly to the users, and the indoor temperature may drop quickly when the air conditioner is cooling, or the indoor temperature may rise quickly when the air conditioner is heating.

In a case where the first air guide assembly 400 reciprocates (e.g., moves up and down) between the first extreme position proximate to the panel 200 and the second extreme position away from the panel 200, the size of the second air outlet 440 changes repeatedly, and a state of the air flowing out from the second air outlet 440 varies repeatedly between the state of the air in the first blowing mode and the state of the air in the second blowing mode, so as to achieve the third blowing mode.

In the third blowing mode, the cold air (or the hot air) is similar to the natural wind and may intermittently blow to the users.

Figure 8A:
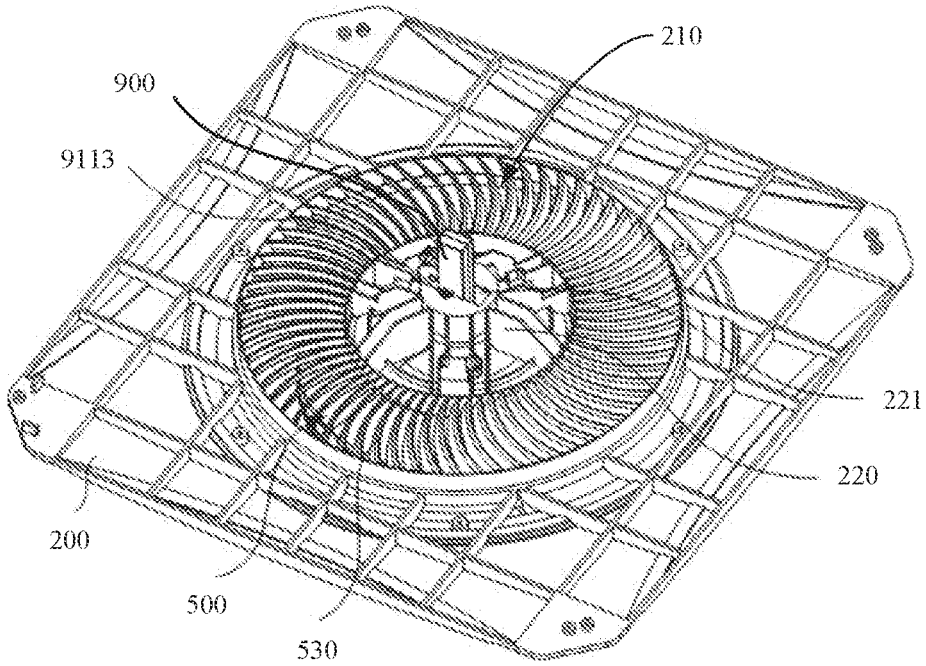
FIG. 8A is a diagram showing a structure of a first air guide assembly assembled with a panel through a first driving assembly, in accordance with some embodiments.
Figure 8B:
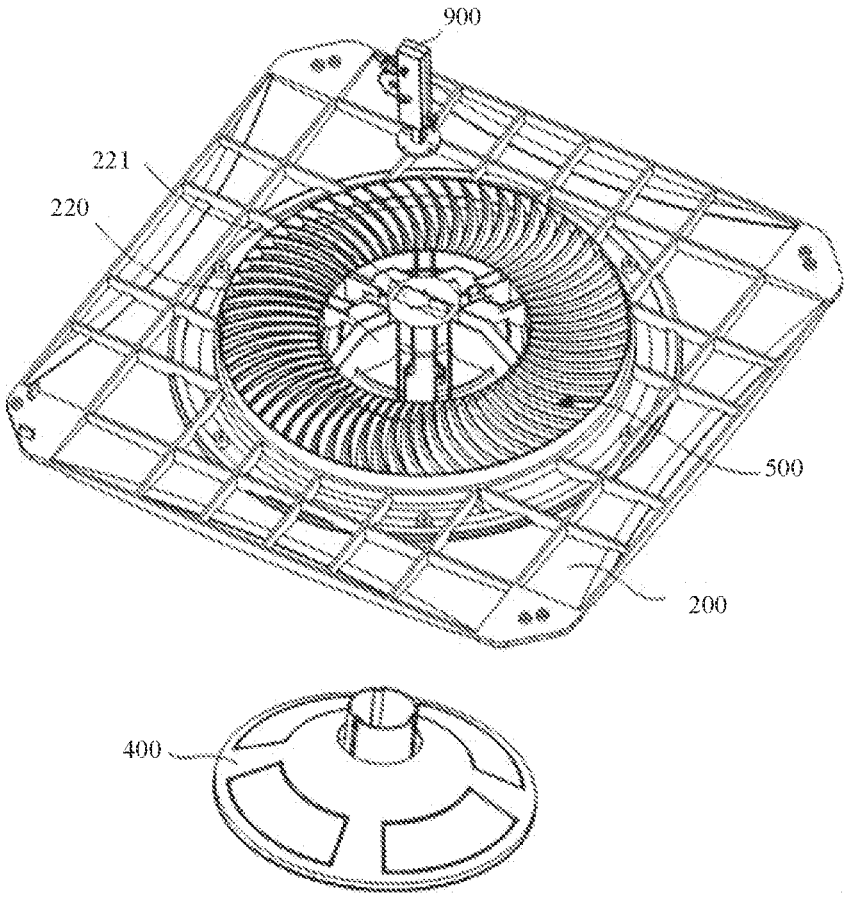
FIG. 8B is an exploded view of the structure shown in FIG. 8A.
Figure 9A:
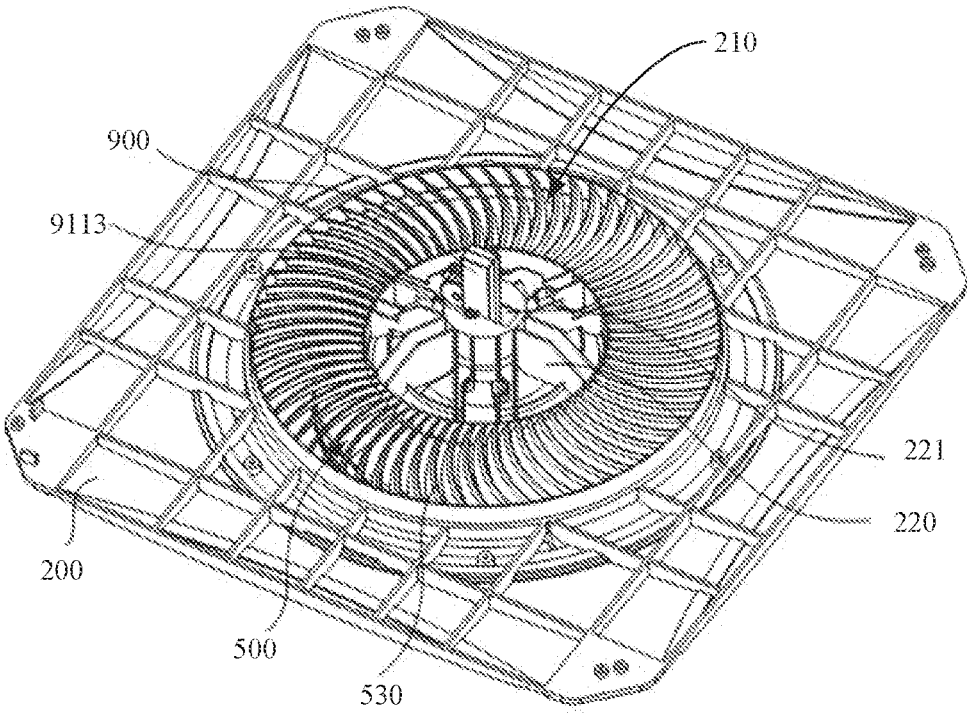
FIG. 9A is a diagram showing a structure of another first air guide assembly assembled with a panel through a first driving assembly, in accordance with some embodiments.
Figure 9B:
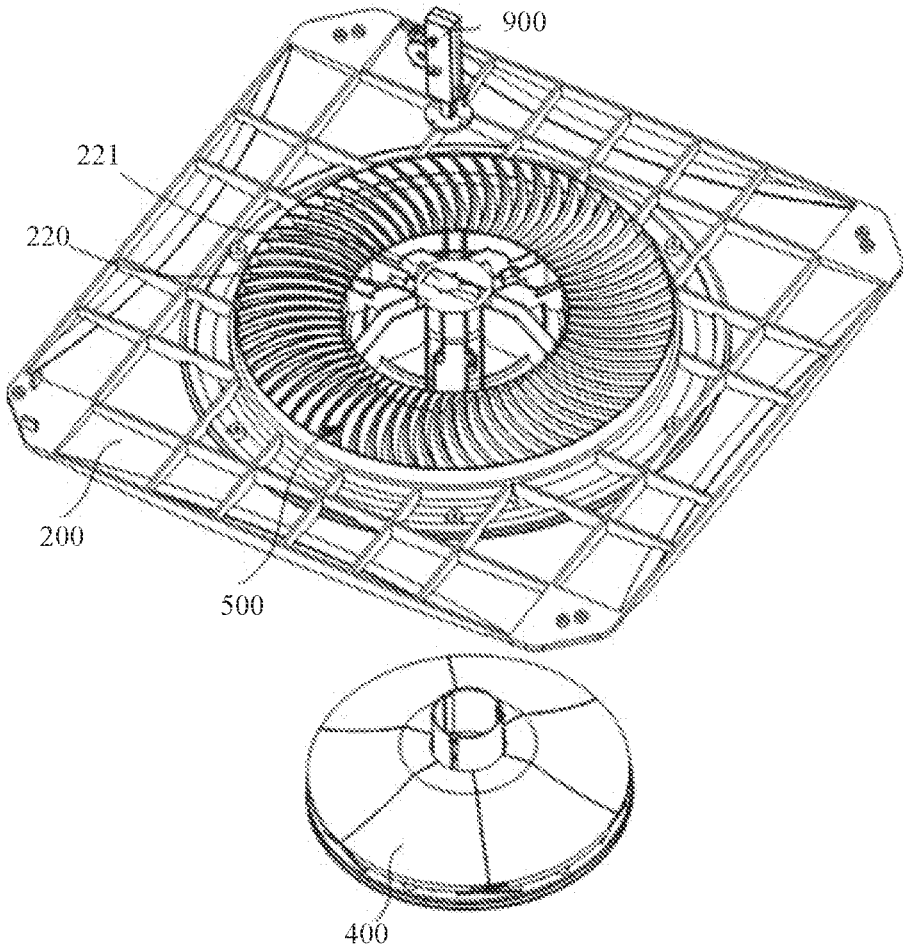
FIG. 9B is an exploded view of the structure shown in FIG. 9A (the second air guide plates being in a retracting state)
Figure 10A:
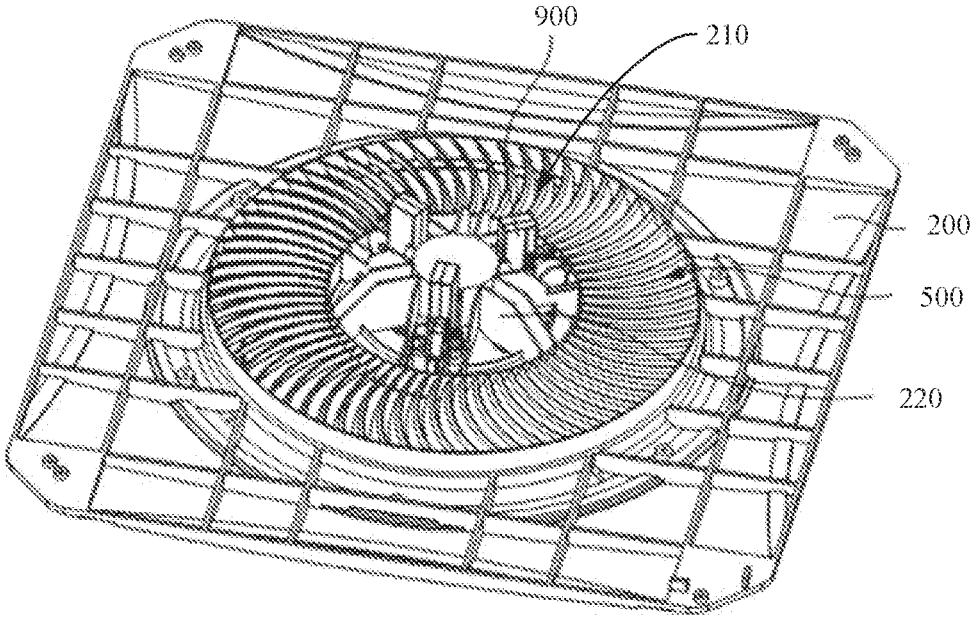
FIG. 10A is a diagram showing a structure of yet another first air guide assembly assembled with a panel through a first driving assembly; in accordance with some embodiments.

In order to install the first air guide assembly 400 on the panel 200 and make the first air guide assembly 400 be able to move in the direction proximate to or away from the panel 200, as shown in FIGS. 8A, 9A and 10A, the air conditioner indoor unit 1000 further includes a first driving assembly 900, and the first driving assembly 900 is configured to drive the first air guide assembly 400 to move.

In some embodiments, as shown in FIGS. 8A, 9A, and 10A, the panel 200 further includes a mounting portion 220, and the first air outlet 210 is disposed around the mounting portion 220. The mounting portion 220 is connected with the first driving assembly 900, and the first driving assembly 900 is connected with the first air guide assembly 400, so that the first air guide assembly 400 is connected with the panel 200 and moves relative to the panel 200.

As shown in FIGS. 8A to 8F, FIGS. 9A to 9L, and FIGS. 10A to 10C, the first air guide assembly 400 includes a bottom plate 410, an air guide portion 420, and a decorative cover 430. It will be noted that the first air guide assembly 400 shown in FIGS. 8A to 8F is the same as the first air guide assembly 400 shown in FIGS. 5A to 5B, and the first air guide assembly 400 shown in FIGS. 9A to 9L is the same as the first air guide assembly 400 shown in FIGS. 6A to 6B, and the first air guide assembly 400 shown in FIGS. 10A to 10C is the same as the first air guide assembly 400 shown in FIGS. 7A to 7C.

The bottom plate 410 is located on a side (e.g., lower portion) of the air guide portion 420 away from the housing 100. The bottom plate 410 is configured to be fixedly connected with the first driving assembly 900, and the first driving assembly 900 drives the bottom plate 410 to move, so as to drive the entire first air guide assembly 400 to move. The bottom plate 410 may be fixedly connected with the air guide portion 420. The bottom plate 410 may be in a shape of a circular plate, however, the present disclosure is not limited thereto.

The air guide portion 420 is an approximately conical structure, and an end portion (e.g., the top portion) of the air guide portion 420 proximate to the housing 100 extends along a curve and extends (e.g., downwards along a curve) to an edge of the air guide portion 420 in a direction away from the housing 100. The air guide portion 420 is configured to guide the air from the first air outlet 210. Here, the edge of the air guide portion 420 is the edge B of the first air guide assembly 400. The air guide portion 420 has a first via hole 421. After an end of the first driving assembly 900 is fixedly connected to the bottom plate 410, the other end of the first driving assembly 900 passes through the first via hole 421 and is fixedly connected to the mounting portion 220 of the panel 200.

The decorative cover 430 is snap-fitted with the air guide portion 420. Alternatively, the decorative cover 430 is snap-fitted with other components of the first air guide assembly 400. The decorative cover 430 is configured to cover the bottom plate 410, so as to improve the aesthetic of the air conditioner indoor unit 1000. In some embodiments, the first air guide assembly 400 may not include the decorative cover 430.

FIGS. 11A and 11B and FIGS. 12A to 12D show two different first driving assemblies 900.

Figure 11A:
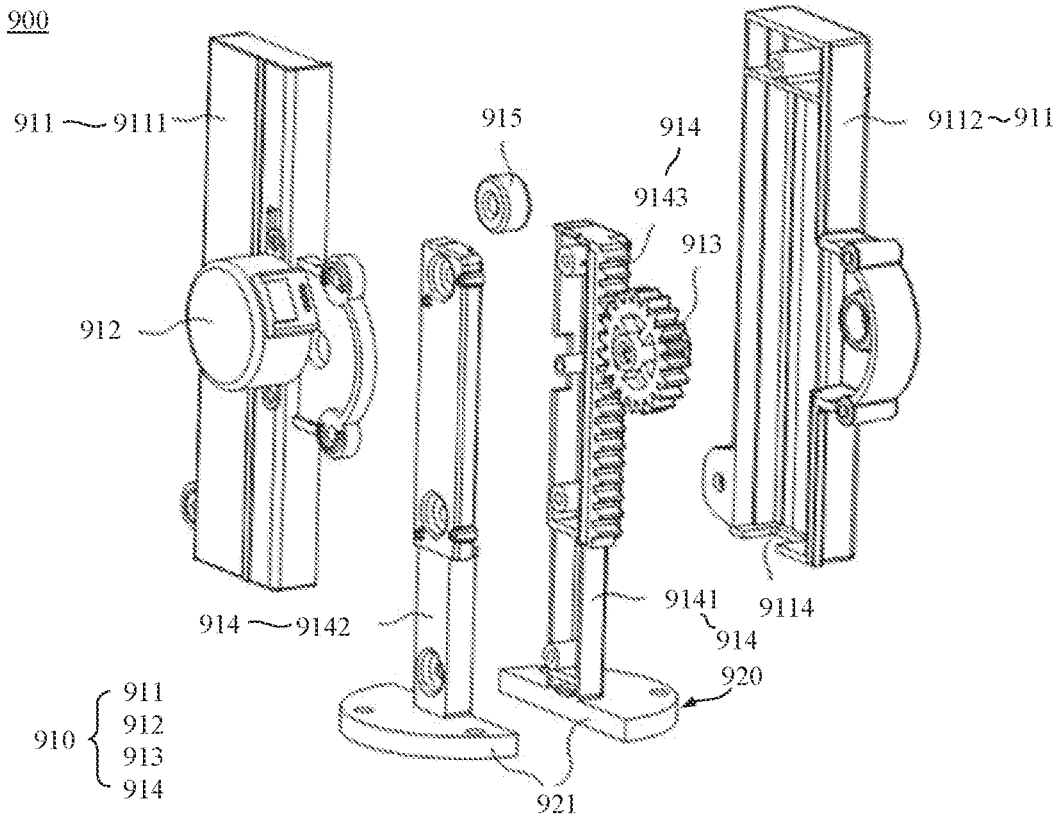
FIG. 11A is an exploded view of a first driving assembly, in accordance with some embodiments.
Figure 11B:
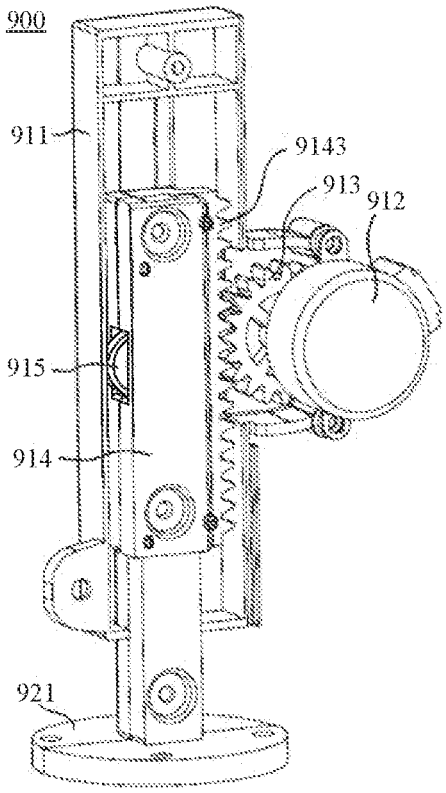
FIG. 11B is an assembly diagram showing the partial structure shown in FIG. 11A.

As shown in FIGS. 11A and 11B, the first driving assembly 900 includes a driving member 910 and a fixing member 920. The driving member 910 includes a shell 911, a third driving motor 912, a rotating gear 913, and a rack portion 914.

The shell 911 may include a plurality of sub-shells. For example, the shell 911 includes a first sub-shell 9111 and a second sub-shell 9112, and the first sub-shell 9111 is fixedly connected with the second sub-shell 9112. The third driving motor 912, the rotating gear 913 and the rack portion 914 are located in a cavity of the shell 911, and a structure of the shell 911 facilitates the installation of these components. The shell 911 further includes a protruding portion 9113 (referring to FIGS. 8A and 9A), and the protruding portion 9113 is located on an outer wall of the shell 911. The protruding portion 9113 is fixedly connected to the mounting portion 220 of the panel 200 by means of screws, so as to achieve the fixed connection between the first driving assembly 900 and the panel 200.

The rack portion 914 may include a plurality of rack sub-portions. For example, the rack portion 914 includes a first rack sub-portion 9141 and a second sub-portion 9142, and the first rack sub-portion 9141 is fixedly connected with the second rack sub-portion 9142. The rack portion 914 further includes a rack segment 9143. The rack segment 9143 is located on the first rack sub-portion 9141 and engages with the rotating gear 913.

The shell 911 further includes a third via hole 9114, and the third via hole 9114 is located at an end portion (e.g., the bottom portion) of the shell 911 away from the housing 100. An end (e.g., the bottom end) of the rack portion 914 away from the housing 100 extends from the third via hole 9114 and is connected to the fixing member 920.

The fixing member 920 includes a connecting plate 921, and the connecting plate 921 is fixedly connected or integrally formed with the rack portion 914. The connecting plate 921 is fixedly connected to the bottom plate 410 of the first air guide assembly 400 through screws, so as to achieve the fixed connection between the first driving assembly 900 and the first air guide assembly 400.

The third driving motor 912 is fixedly connected with the rotating gear 913 and is configured to drive the rotating gear 913 to rotate, so that the rotating gear 913 rotates to drive the rack segment 9143 to move (e.g., to move up and down). Since the shell 911 is fixedly connected with the mounting portion 220 of the panel 200, and the rack portion 914 is fixedly connected with the bottom plate 410 of the first air guide assembly 400, when the rack segment 9143 drives the entire rack portion 914 to move up and down, the rack portion 914 may drive the entire first air guide assembly 400 to move up and down relative to the shell 911.

In some embodiments, the driving member 910 further includes a rolling wheel 915. A mounting shaft of the rolling wheel 915 is located in the rack portion 914, and a structure of the rack portion 914 facilitates the installation of the rolling wheel 915. A first portion of the rolling wheel 915 is located in a cavity of the rack portion 914, and a second portion of the rolling wheel 915 is located outside the cavity of the rack portion 914. The second portion of the rolling wheel 915 exposed from the rack portion 914 is in rolling contact with an inner wall of the shell 911. The rolling wheel 915 may improve the reliability and stability of the rack portion 914 when the rack portion 914 is moving up and down. Moreover, by providing the rolling wheel 915, it is conducive to reducing the friction between the rack portion 914 and the shell 911 when the rack portion 914 is moving.

When the first driving assembly 900 drives the entire first air guide assembly 400 to move up and down, the first air guide assembly 400 may be in a position shown in FIGS. 5A and 6A, or in a position shown in FIGS. 5B and 6B, or in any position between the two positions.

In a case where the first driving assembly 900 shown in FIGS. 11A and 11B is used, the first air guide assembly 400 may perform a vertical movement but may not rotate. In this case, the first air guide assembly 400 may be connected to the panel 200 through one first driving assembly 900. Of course, in some embodiments, a plurality of first driving assemblies 900 may also be used to perform the vertical movement of the first air guide assembly 400.

In a case where one first driving assembly 900 is used, as shown in FIGS. 8A to 8F and FIGS. 9A to 9L, the bottom plate 410 includes a connecting portion 411. For example, the connecting portion 411 is a cylindrical structure. The connecting portion 411 extends (e.g., upwards) in a direction away from the bottom plate 410 from a center of the bottom plate 410. A first cavity 412A is provided in the connecting portion 411, and a side (e.g., the upper side) of the first cavity 412A away from the bottom plate 410 is open, so that the first driving assembly 900 may protrude into the first cavity 412A. In this way, the fixing member 920 (e.g., the connecting plate 921) of the first driving assembly 900 may be fixedly connected to a bottom portion 413 (as shown in FIGS. 5A and 9L) of the first cavity 412A. For example, the fixing member 920 is fixedly connected to the bottom portion 413 of the first cavity 412A through screws.

Figure 8C:
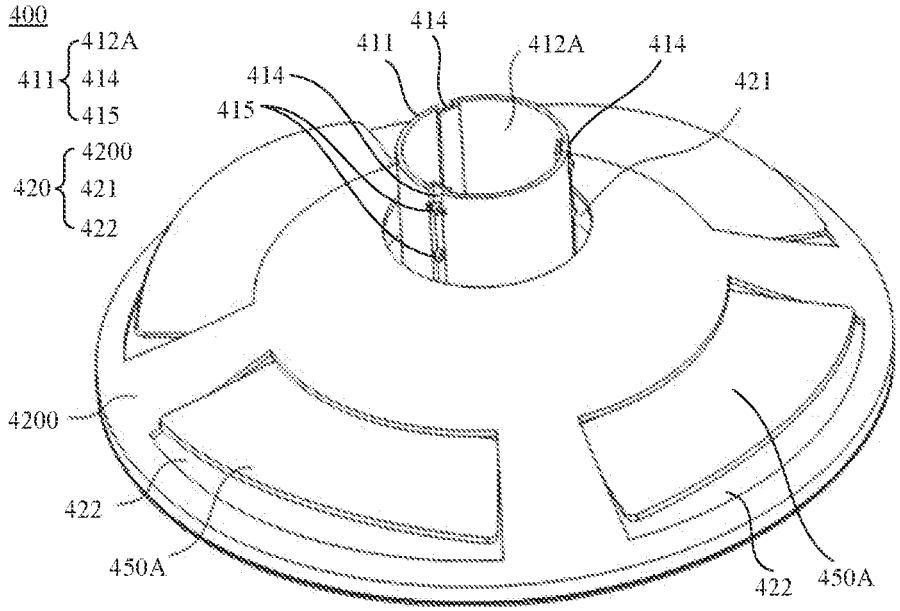
FIG. 8C is a diagram showing a structure of the first air guide assembly in FIG. 8A.
Figure 9C:
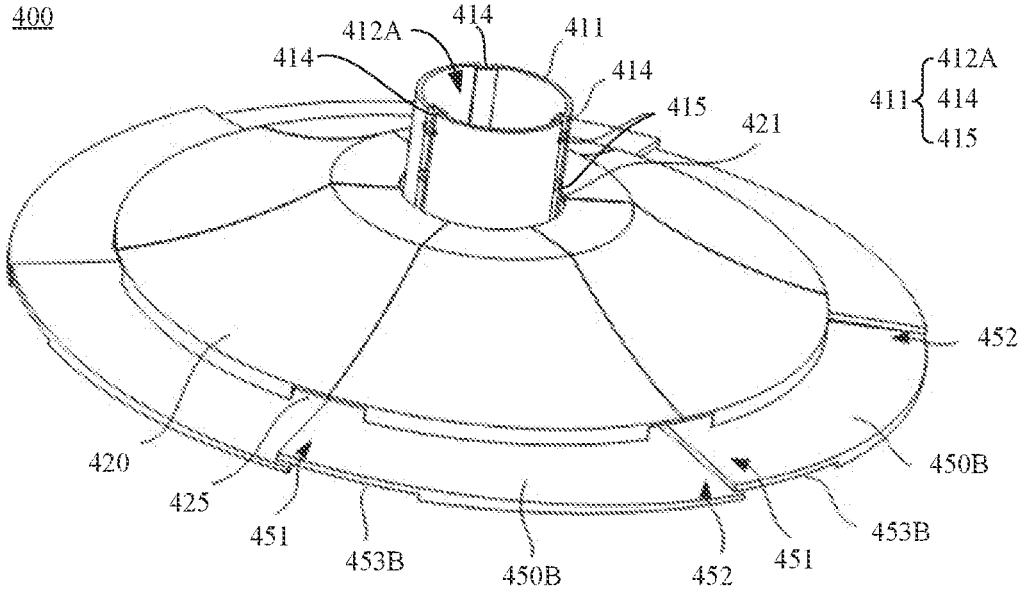
FIG. 9C is a diagram showing a structure of the first air guide assembly in FIG. 9A (the second air guide plates being in a stretching out state)
Figure 10B:
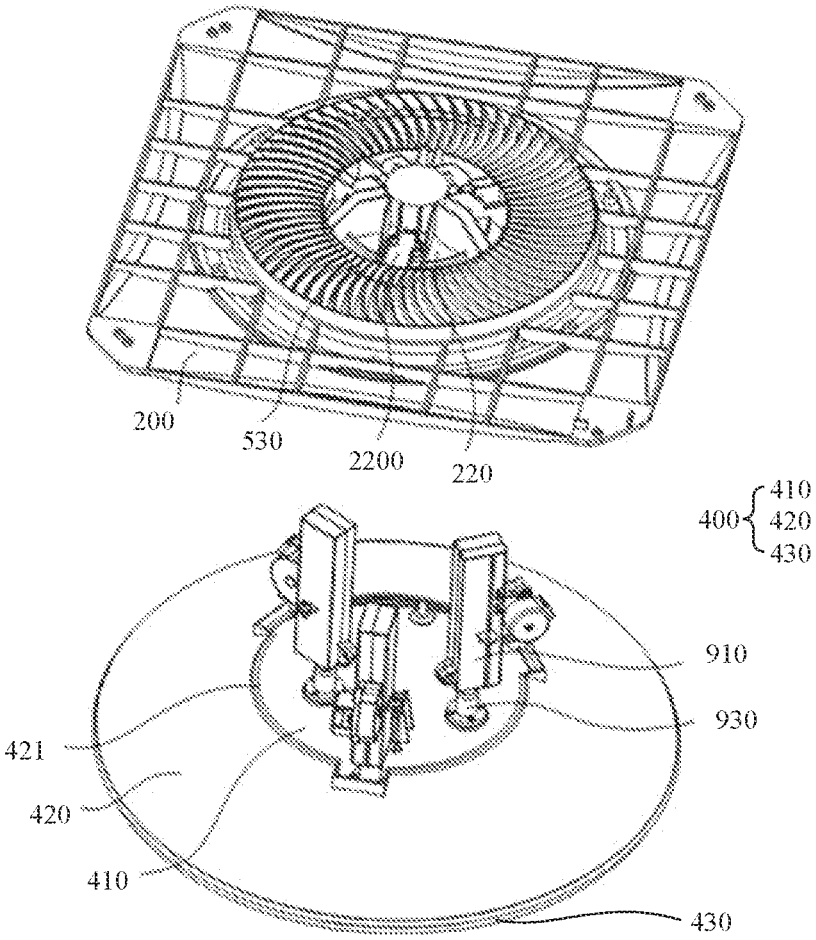
FIG. 10B is an exploded view of the structure shown in FIG. 10A.
Figure 10C:
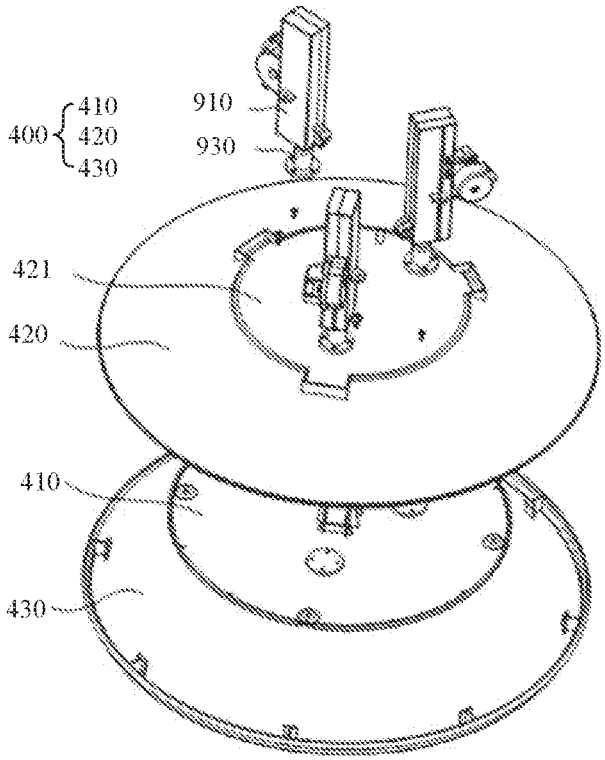
FIG. 10C is an exploded view of the first air guide assembly and the first driving assembly in FIG. 10B.

As shown in FIGS. 8C and 9C, the air guide portion 420 has a first via hole 421. An end portion (e.g., the top portion) of the connecting portion 411 proximate to the housing 100 extends from the first via hole 421, so that the first driving assembly 900 may also extend from the first via hole 421. In this case, the air guide portion 420 is clamped with the connecting portion 411, and a portion of the first driving assembly 900 extending out from the air guide portion 420 is fixedly connected to the mounting portion 220 of the panel 200 through the protruding portion 9113.

In some embodiments, as shown in FIGS. 8A to 8F and FIGS. 9A to 9L, the connecting portion 411 includes a plurality of third slideways 414 and a plurality of ball bearings 415. Two or more ball bearings 415 are provided in each third slideway 414. For example, as shown in FIGS. 8C and 9C, the connecting portion 411 includes three third slideways 414 arranged at equal intervals along a circumferential direction of the connecting portion 411, and two ball bearings 415 arranged at an interval are embedded in each third slideway 414.

As shown in FIGS. 5A and 6A, the mounting portion 220 includes a mounting cavity 221. The mounting cavity 221 may be a cylindrical cavity. The connecting portion 411 extends into the mounting cavity 221, and the ball bearings 415 are in the rolling contact with an inner wall of the mounting cavity 221. When the first air guide assembly 400 is performing the vertical movement due to the action of the first driving assembly 900, the rack portion 914 may slide along the inner wall of the shell 911 through the rolling wheel 915, and the rack portion 914 may drive the connecting portion 411 to slide along the inner wall of the mounting cavity 221 through the ball bearings 415. In this way, by providing the ball bearings 415, it is possible to improve the reliability and stability of the entire movement of the first air guide assembly 400 and be conducive to reducing the friction between the connecting portion 411 and the mounting portion 220 when the connecting portion 411 is moving.

In some embodiments, as shown in FIGS. 5A and 6A, the mounting portion 220 has a limiting portion 222. A shape of the limiting portion 222 matches a shape of the air guide portion 420. For example, the limiting portion 222 is also an approximately conical structure. When the air guide portion 420 is moving in the direction proximate to the panel 200, the air guide portion 420 may abut against the limiting portion 222, so that the first air guide assembly 400 is limited by the limiting portion 222.

FIGS. 12A to 12D show another first driving assembly 900. Besides the driving member 910 and the fixing member 920, the first driving assembly 900 further includes a rotating member 930. The rotating member 930 is located between the driving member 910 and the fixing member 920. The structures and functions of the driving member 910 and the fixing member 920 are the same as that of the above driving member 910 and fixing member 920, and details will not be repeated here.

Figure 12A:
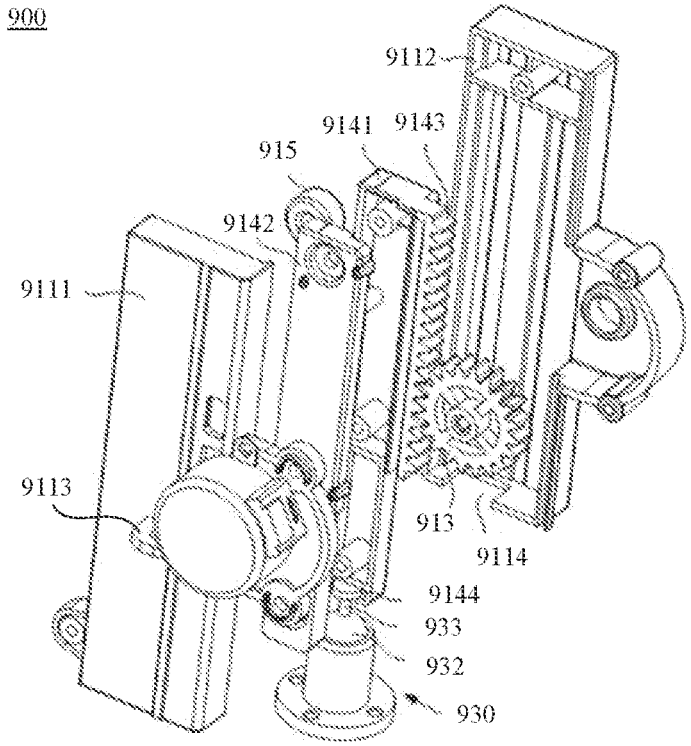
FIG. 12A is an exploded view of another first driving assembly, in accordance with some embodiments.
Figure 12B:
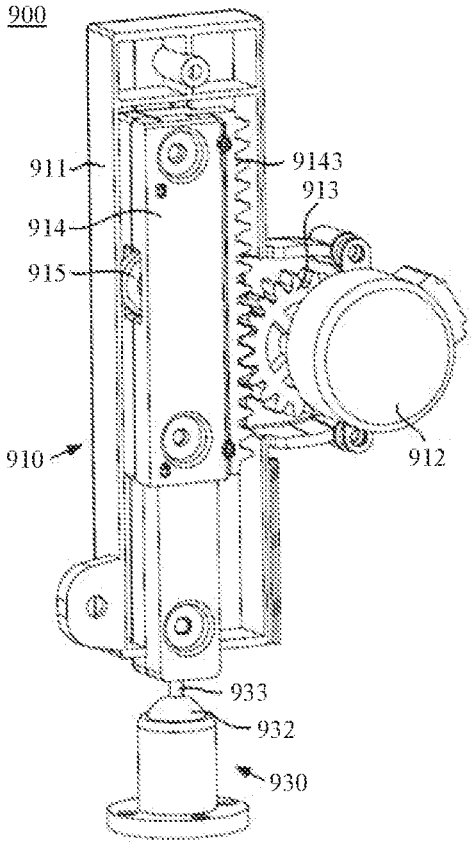
FIG. 12B is an assembly diagram showing the partial structure shown in FIG. 12A.
Figure 12C:
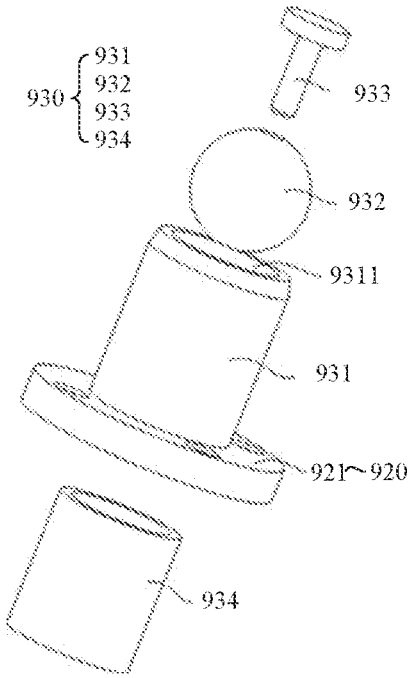
FIG. 12C is an exploded view of the rotating member and the fixing member shown in FIG. 12A.
Figure 12D:
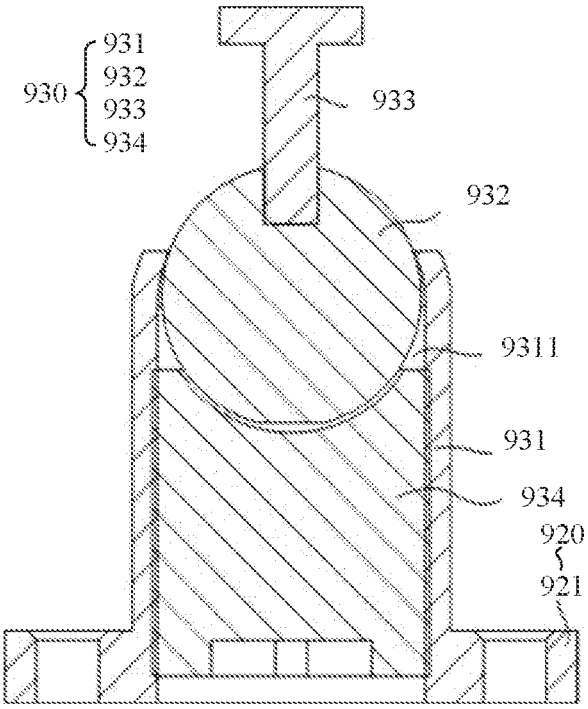
FIG. 12D is a sectional view of the rotating member and the fixing member shown in FIG. 12A.

As shown in FIG. 12C, the rotating member 930 includes a base 931, a rolling ball 932, a pin 933, and a limiting block 934. The base 931 is connected with the fixing member 920 and includes an accommodating cavity 9311. A first portion (e.g., the top portion) of the accommodating cavity 9311 proximate to the driving member 910 is slightly smaller than a second portion of the accommodating cavity 9311 away from the driving member 910, so as to limit the rolling ball 932. The rolling ball 932 is embedded in the accommodating cavity 9311 and is rotatable in the accommodating cavity 9311. The limiting block 934 is disposed in the accommodating cavity 9311 and located on a side (e.g., the lower side) of the rolling ball 932 away from the driving member 910, so as to contact the rolling ball 932 to limit the rolling ball 932.

An end of the pin 933 is fixedly connected with the rolling ball 932, and the other end of the pin 933 extends into the rack portion 914. The rack portion 914 further includes a second groove 9144 (as shown in FIG. 12A) capable of fixing and limiting the pin 933. The pin 933 connects the driving member 910 and the rotating member 930, and the pin 933 does not affect the action of the driving member 910 and the rotating member 930.

The connecting plate 921 of the fixing member 920 is fixedly connected with the base 931. Alternatively, the connecting plate 921 of the fixing member 920 is integrally formed with the base 931.

When the first driving assembly 900 is driving the entire first air guide assembly 400 to move up and down, the first air guide assembly 400 may be in a position shown in FIG. 7A or 7B. When the first driving assembly 900 is driving the first air guide assembly 400 to rotate, the first air guide assembly 400 may be in a position shown in FIG. 7C.

As shown in FIGS. 10A to 10C, the air conditioner indoor unit 1000 includes a plurality of first driving assemblies 900. For example, in a case where the air conditioner indoor unit 1000 includes three first driving assemblies 900, the three first driving assemblies 900 are arranged around a central axis of panel 200 in a circumferential direction, and the three first driving assemblies 900 are arranged at equal intervals. When the three first driving assemblies 900 are operating synchronously, the three first driving assemblies 900 may drive the first air guide assembly 400 to move up and down. When the three first driving assemblies 900 are operating asynchronously, the three first driving assemblies 900 may drive the first air guide assembly 400 to tilt relative to the panel 200.

Figure 7C:
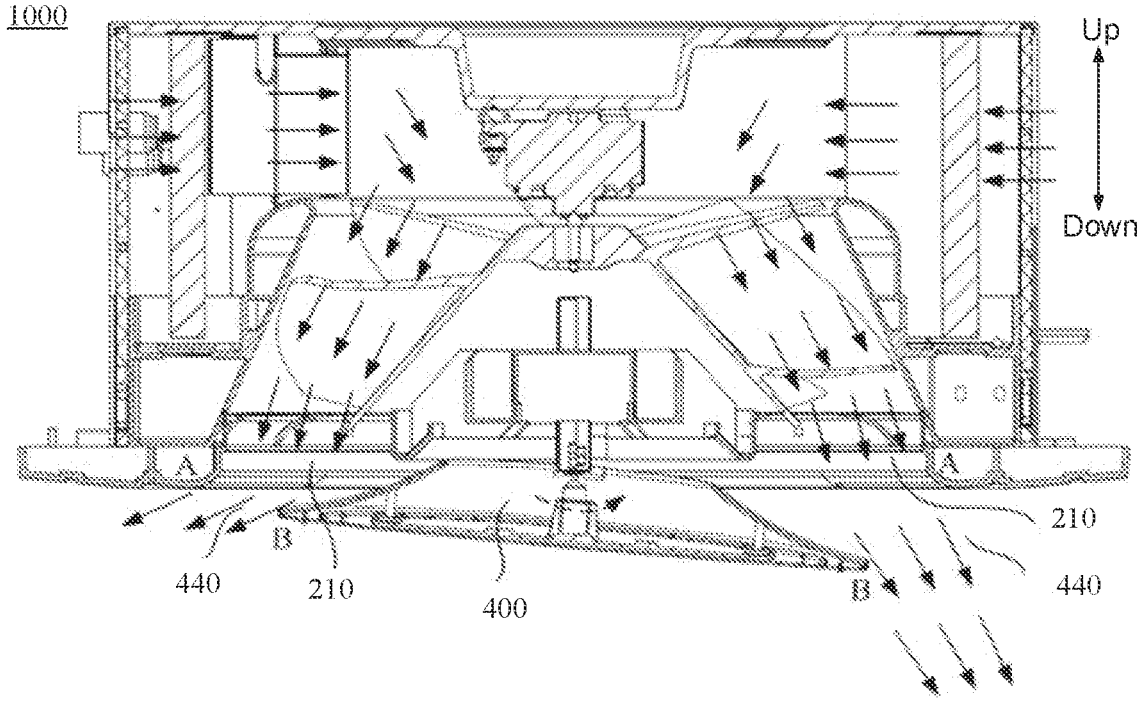
FIG. 7C is a sectional view of yet another air conditioner indoor unit in a third blowing mode, in accordance with some embodiments.

For example, in a case where the air conditioner indoor unit 1000 includes three first driving assemblies 900, it is assumed that one first driving assembly 900 does not move, and the other two first driving assemblies 900 operate synchronously and drive the first air guide assembly 400 to move downwards. In this case, as shown in FIG. 7C, the rotating members 930 of the three first driving assemblies 900 rotate, so that the first air guide assembly 400 may rotate and tilt. As a result, the first air guide assembly 400 may tilt relative to the panel 200, so as to adjust air supply angles and air supply volumes in different directions.

It will be noted that, in the case where the air conditioner indoor unit 1000 includes the plurality of first driving assemblies 900, as shown in FIG. 10B, the mounting portion 220 further includes a plurality of third openings 2200, and the plurality of first driving assemblies 900 may respectively pass through the plurality of third openings 2200 and be fixedly connected with the corresponding mounting portion 220.

In some embodiments, if the plurality of first driving assemblies 900 operate alternately according to a time period, the first air guide assembly 400 swing around the central axis of the panel 200 may be achieved, so that the air supply volumes and air supply angles in different directions may change periodically, so as to achieve a 360° air supply and improve the uniformity of the air supply.

The vertical movement (e.g., moving up and down) and the tilting movement of the first air guide assembly 400 relative to the panel 200 may occur simultaneously. In this way, the vertical movement and the tilting movement of the first air guide assembly 400 may be coordinated with each other, so as to precisely control the air supply volume and the air supply angle, thereby achieving different blowing modes of the air conditioner indoor unit 1000.

It will be noted that, in some embodiments, the air conditioner indoor unit 1000 may not include the first driving assembly 900. In this case, the first air guide assembly 400 may be directly connected to the panel 200, or the first air guide assembly 400 may be indirectly connected to the panel 200 through other connecting members. Alternatively, in some embodiments, the first driving assembly 900 may include the rotating member 930 and the fixing member 920 without including the driving member 910. In this case, the first driving assembly 900 may drive the first air guide assembly 400 to perform the tilting movement.

In some embodiments of the present disclosure, in addition to controlling the flow direction of the air flowing out from the second air outlet 440 through at least one of the vertical movement or the tilting movement of the first air guide assembly 400 driven by the first driving assembly 900, it is also possible to control the flow direction of the air flowing out from the second air outlet 440 through the air guide plate of the first air guide assembly 400. FIGS. 8A to 8F, and FIGS. 9A to 9L each show two different air guide plates.

FIGS. 8A to 8F show an air guide plate. In some embodiments, as shown in FIGS. 8A to 8F, the first air guide assembly 400 includes a plurality of first air guide plates 450A. The plurality of first air guide plates 450A are located on the bottom plate 410, and the plurality of first air guide plates 450A may swing up and down relative to the bottom plate 410. Through the swing of the first air guide plates 450A, it is possible to adjust the flow direction of the air flowing out from the second air outlet 440, so as to achieve the adjustment of the air supply angle.

Figure 8D:
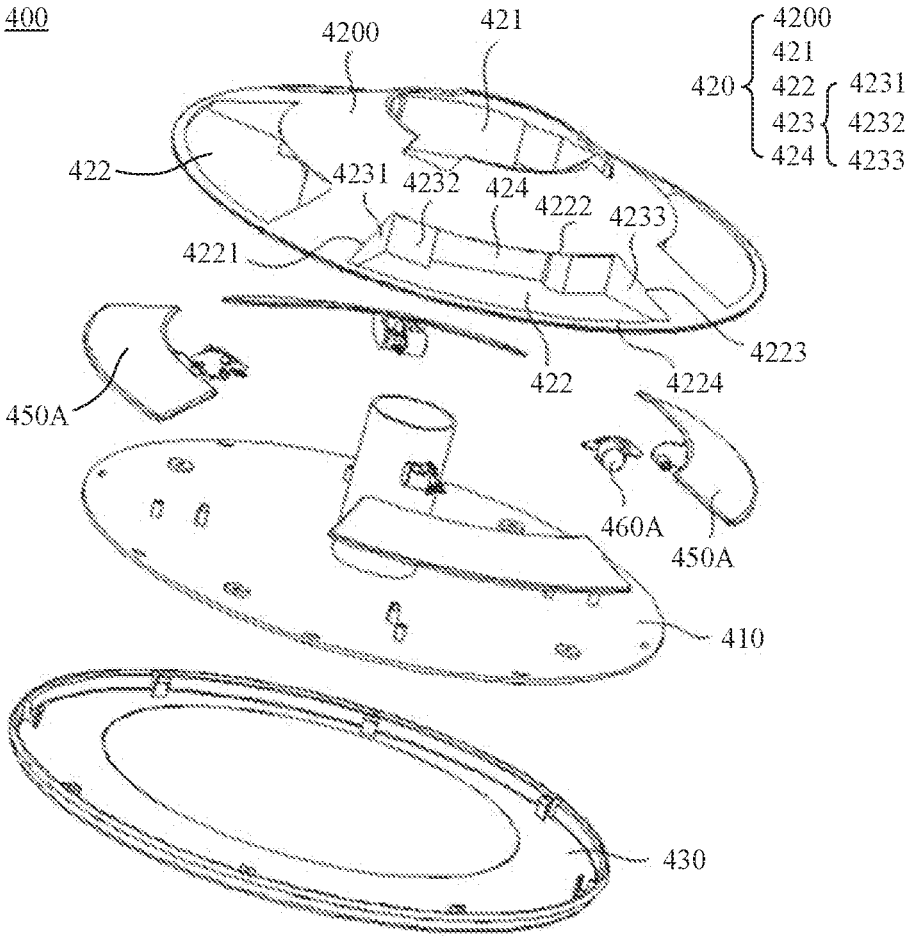
FIG. 8D is an exploded view of the structure shown in FIG. 8C.

In this case, as shown in FIGS. 8C and 8D, the air guide portion 420 includes an air guide portion body 4200 and a plurality of first openings 422, and the plurality of first openings 422 penetrate the air guide portion body 4200. The plurality of first air guide plates 450A correspond to the plurality of first openings 422 and are located in the plurality of first openings 422, respectively. A curvature of a surface of the first air guide plate 450A is substantially the same as a curvature of a surface of the air guide portion 420. In this way, in a case where the first air guide plates 450A do not swing, the first air guide plates 450A and the air guide portion 420 may form an integral structure, and a surface of the integral structure is smooth, so as to achieve a good air guide effect.

In some embodiments, as shown in FIG. 8D, the air guide portion 420 further includes a support rib 423. The support rib 423 is disposed on a side (e.g., the lower side) of the air guide portion body 4200 proximate to the bottom plate 410, and the support rib 423 abuts against the bottom plate 410. By providing the support rib 423, it is possible to improve the structural strength and installation stability of the air guide portion 420 and prevent the air from entering the first air guide assembly 400 through the first openings 422.

In some embodiments, as shown in FIG. 8D, the air guide portion 420 includes a plurality of support ribs 423, and the plurality of support ribs 423 correspond to the plurality of first openings 422. For example, one first opening 422 corresponds to two or more support ribs 423. The two or more support ribs corresponding to one first opening 422 include a first support rib 4231, a second support rib 4232, and a third support rib 4233. The first opening 422 has a first side edge 4221 and a third side edge 4223 opposite to each other, and a second side edge 4222 and a fourth side edge 4224 opposite to each other. The first support rib 4231 extends (e.g., downwards) to the bottom plate 410 from the first side edge 4221 in a direction away from the housing 100 and abuts against the bottom plate 410, and the second support rib 4232 extends downwards from the second side edge 4222 to the bottom plate 410 and abuts against the bottom plate 410, and the third support rib 4233 extends downwards from the third side edge 4223 to the bottom plate 410 and abuts against the bottom plate 410.

In some embodiments, one first air guide plate 450A swings through an independent driving mechanism. Swing angles of the plurality of first air guide plates 450A may be different from each other. In a case where the swing angles of the plurality of first air guide plates 450A are different from each other, the air supply angles of the air conditioner indoor unit 1000 in different directions are different from each other, which further satisfies different air supply demands of the users.

Since the air guide portion 420 has an approximately conical structure, a space may be formed between the bottom plate 410 and the air guide portion 420. The space may provide space for the swing of the first air guide plates 450A and the arrangement of the driving mechanisms of the first air guide plates 450A. The first air guide assembly 400 further includes a first driving motor 460A, and the first driving motor 460A is connected to the first air guide plate 450A. The first driving motor 460A is configured to drive the first air guide plate 450A to swing relative to the bottom plate 410 in the first opening 422 of the air guide portion 420, so as to adjust the flow direction of the air.

Figure 8E:
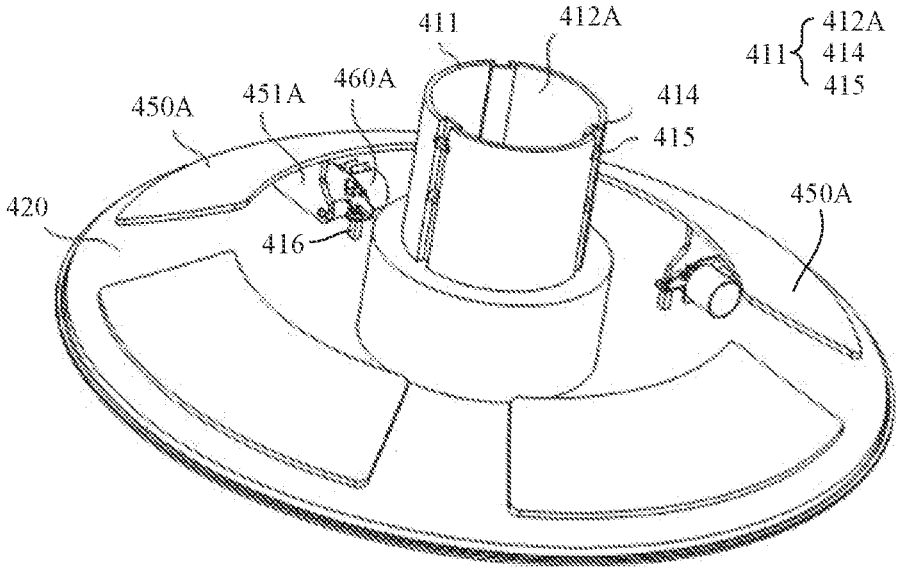
FIG. 8E is a diagram showing a structure of the first air guide assembly in FIG. 8C without an air guide portion.
Figure 8F:
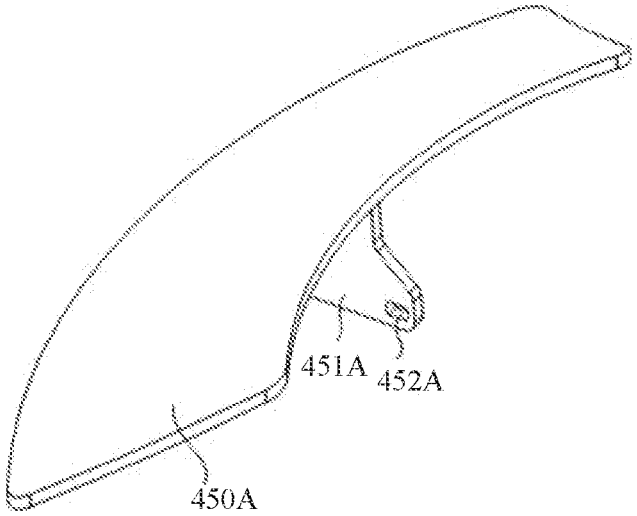
FIG. 8F is a diagram showing a structure of the first air guide plate in FIG. 8E.

In some embodiments, as shown in FIGS. 8E and 8F, the first air guide plates 450A each include a connecting rib 451A and a connecting hole 452A, and the connecting hole 452A is disposed in the connecting rib 451A. The bottom plate 410 includes a mounting column 416. The first driving motor 460A is fixedly disposed on the mounting column 416, and a motor shaft of the first driving motor 460A is connected to the connecting hole 452A. In this way, it is possible to control the movement of the first air guide plate 450A through the first driving motor 460A.

As shown in FIG. 8D, the air guide portion 420 further includes a third groove 424. The third groove 424 is disposed on the second support rib 4232 and is recessed in a direction away from the corresponding first air guide plate 450A. The first driving motor 460A is located in the third groove 424.

In the first blowing mode, the second blowing mode or the third blowing mode, the first air guide plates 450A may be movable, so as to further adjust the flow direction of the air in each blowing mode.

In addition, the up and down swing of the first air guide plates 450A may be performed simultaneously with at least one of the vertical movement or the tilting movement of the first air guide assembly 400, so as to achieve different blowing modes.

Of course, the swing manner of the first air guide plates 450A is not limited thereto. In some embodiments, the first air guide plates 450A each may be hinged to a side (e.g., the upper side) of the corresponding first opening 422 proximate to the housing 100 and may be turned over at an angle with the upper side of the first opening 422 as axis. In this case, the first air guide plates 450A may be driven to swing by a device such as a motor, a cylinder, or a hydraulic cylinder.

FIGS. 9A to 9L show another air guide plate. In some embodiments, as shown in FIGS. 9A and 9L, the first air guide assembly 400 includes a plurality of second air guide plates 450B. The plurality of second air guide plates 450B are switchable between a first state and a second state. In the first state, the plurality of second air guide plates 450B may stretch out from the air guide portion 420; in the second state, the plurality of second air guide plates 450B may retract into the air guide portion 420. In this way, by switching the second air guide plates 450B in the first state and the second state, it is possible to adjust the size of the second air outlet 440, so as to adjust the flow direction of the air flowing out from the second air outlet 440, thereby achieving the adjustment of the air supply angle.

In a case where the second air guide plates 450B are in the first state, the edge of the entire first air guide assembly 400 increases, and the size of the second air outlet 440 is reduced. In a case where the second air guide plates 450B are in the second state, the edge of the entire first air guide assembly 400 is reduced, and the size of the second air outlet 440 increases.

In some embodiments, as shown in FIG. 9C, in a case where the plurality of second air guide plates 450B are in the first state, two adjacent second air guide plates 450B at least partially overlap with each other in an up-and-down direction, so as to avoid a gap between the two adjacent second air guide plates 450B, which affects the air guide effect.

Figure 9D:
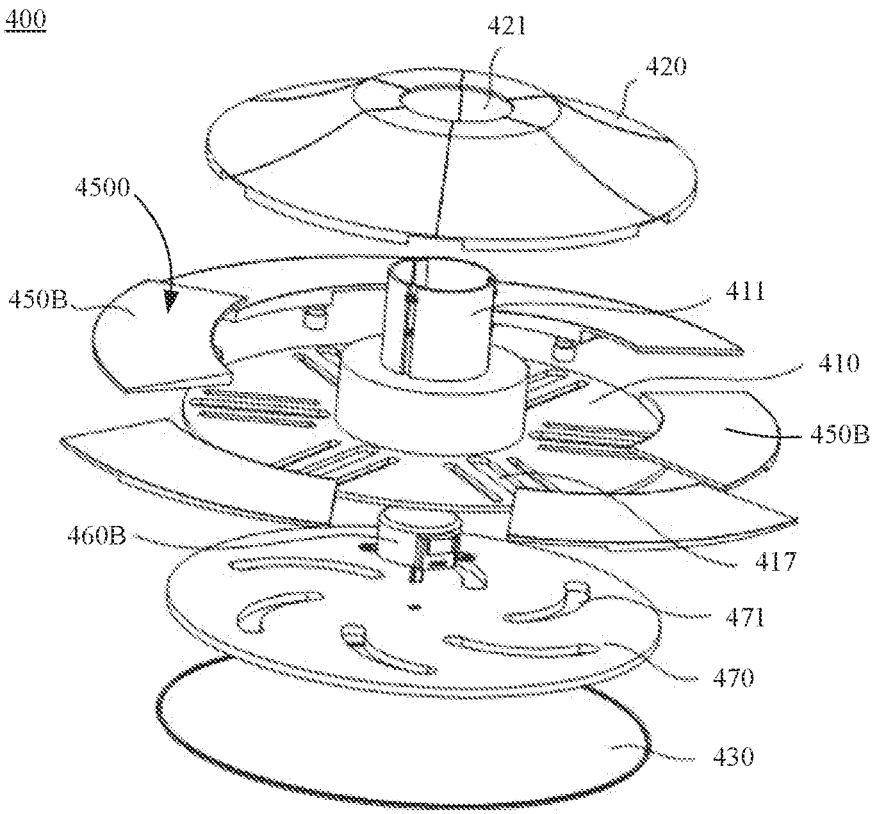
FIG. 9D is an exploded view of the structure shown in FIG. 9C.
Figure 9E:
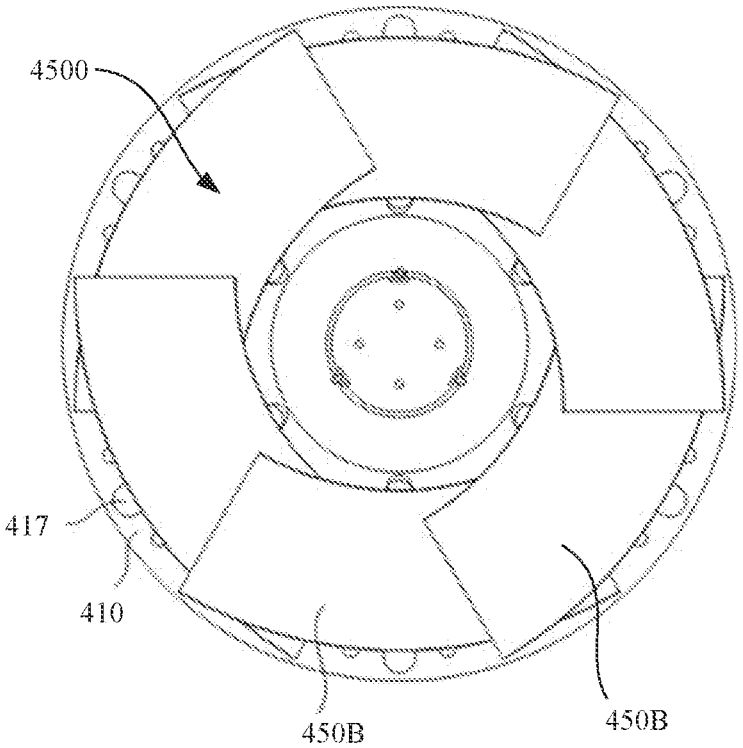
FIG. 9E is a diagram showing a structure of the first air guide assembly in FIG. 9C without an air guide portion (the second air guide plates being in a retracting state)
Figure 9F:
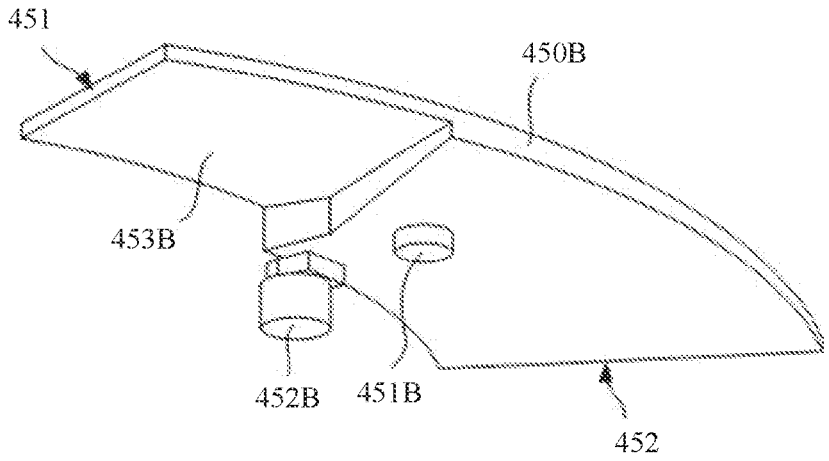
FIG. 9F is a diagram showing a structure of the second air guide plate in FIG. 9E.
Figure 9G:
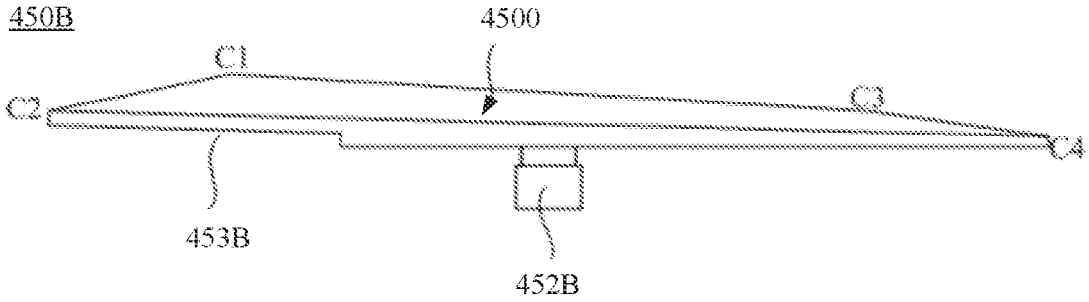
FIG. 9G is a diagram showing another structure of the second air guide plate in FIG. 9E.
Figure 9H:
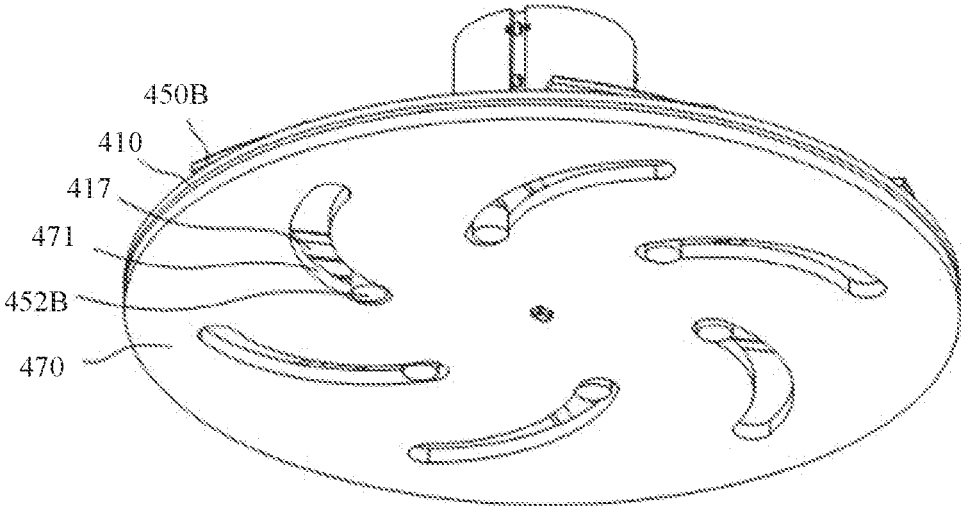
FIG. 9H is an assembly diagram of a second air guide plate, a driving plate and a bottom plate, in accordance with some embodiments.

As shown in FIG. 9D, the first air guide assembly 400 further includes a second driving motor 460B and a driving plate 470. The second driving motor 460B is connected to the driving plate 470, and the second driving motor 460B is configured to drive the driving plate 470 to rotate. When the second driving motor 466B is driving the driving plate 470 to rotate, the driving plate 470 may drive the plurality of second air guide plates 466B to stretch out or retract relative to the air guide portion 420 in a radial direction of the bottom plate 410.

Figure 9I:
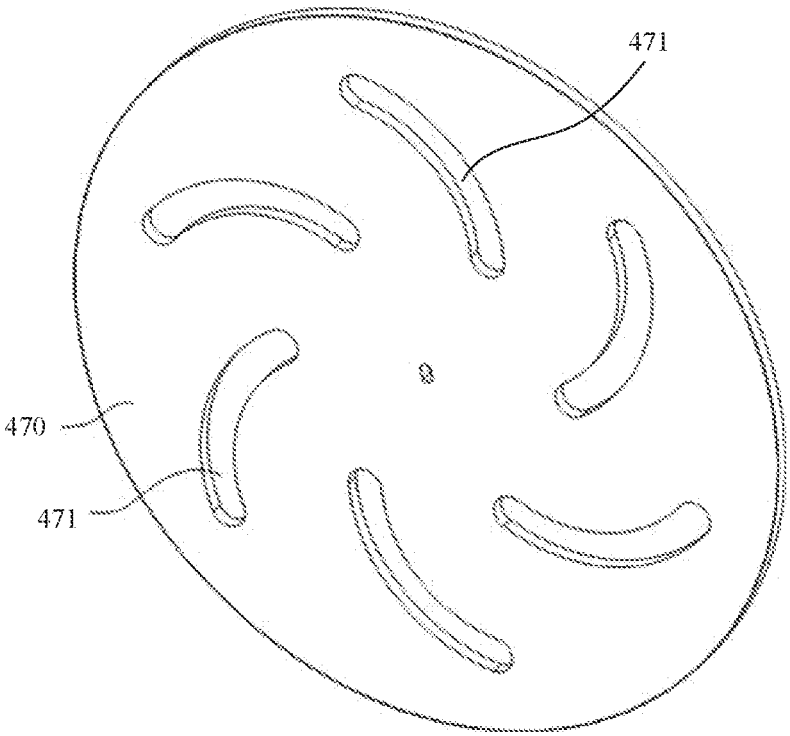
FIG. 9I is a diagram showing a structure of the driving plate in FIG. 9H.
Figure 9J:
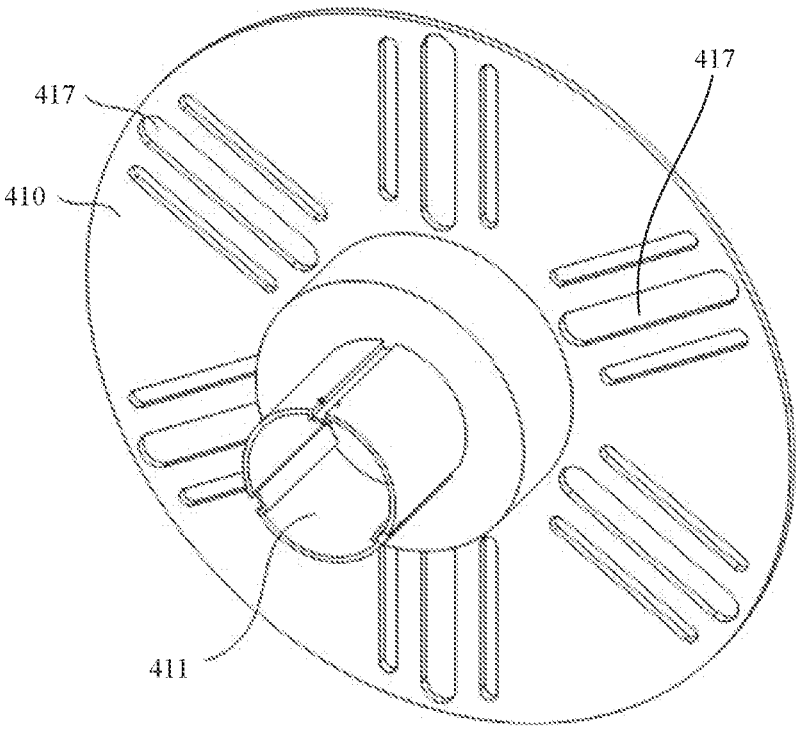
FIG. 9J is a diagram showing a structure of the bottom plate in FIG. 9H.

As shown in FIG. 9I, the driving plate 470 includes a plurality of second slideways 471. The second slideways 471 each are in a shape of an arc, and trajectory of the second slideway 471 is fitted according to the radial movement of the second air guide plates 450B and a rotational movement of the driving plate 470. As shown in FIG. 9J, the bottom plate 410 includes a plurality of first slideways 417 arranged at intervals, and the plurality of first slideways 417 each are in a shape of a straight line. The plurality of first slideways 417 each extend in a direction away from a central axis of the bottom plate 410, and the plurality of first slideways 417 are arranged at intervals around the central axis of the bottom plate 410.

The plurality of second slideways 471 correspond to the plurality of first slideways 417 respectively, and a combination formed by one second slideway 471 and one corresponding first slideway 417 corresponds to one second air guide plate 450B. For example, as shown in FIG. 9E, the first air guide assembly 400 includes six second air guide plates 450B. In this case, the driving plate 470 includes six second slideways 471, and the bottom plate 410 includes six first slideways 417. In this way, the plurality of second air guide plates 450B may be driven by one driving plate 470.

As shown in FIG. 9F, the second air guide plates 450B each include a first guide protrusion 451B and a second guide protrusion 452B. The first guide protrusion 451B is slidably disposed in the first slideway 417, and the second guide protrusion 452B is slidably disposed in the second slideway 471.

The second driving motor 460B drives the driving plate 470 to rotate, and the second slideways 471 each apply force to the second guide protrusion 452B, so that the corresponding second air guide plate 450B has a movement tendency of rotating. However, since the first guide protrusion 451B is located in the first slideway 417 and is limited by the first slideway 417, the second guide plate 450B cannot rotate, but slides along the first slideway 417, so that the second guide plates 450B may switch between the first state and the second state.

In some embodiments, as shown in FIGS. 9D and 9E, a windward surface 4500 of the second air guide plate 450B is a curved surface with air guide performance, so as to improve the air guide effect. For example, the windward surface 4500 of the second air guide plate 450B is a helical surface, or an arc surface. It will be noted that, the windward surface 4500 of the second air guide plate 450B is a surface of the second air guide plate 450B facing the first air outlet 210.

In some embodiments, the windward surface 4500 of the second air guide plate 450B may be a helical surface. It will be noted that, since a size of the second air guide plate 450B is limited, the helical surface may be a portion of a complete helical surface.

For example, as shown in FIG. 9G, four corners of the windward surface 4500 of the second air guide plate 450B are marked as points C1, C2, C3, and C4 respectively. A position height of the point C1 is greater than that of the point C2, the position height of the point C2 is greater than that of the point C3, and the position height of the point C3 is greater than that of the point C4. In this case, as shown in FIG. 9F, two opposite ends of the second air guide plate 450B are a first side 451 and a second side 452, respectively, and the first side 451 is higher than the second side 452. The points C1 and C2 are located on the first side 451, and the points C3 and C4 are located on the second side 452.

In some embodiments, as shown in FIGS. 9F and 9G, the second air guide plates 450B each further include a first groove 453B. A portion of a surface (e.g., the bottom surface) of the second air guide plate 450B proximate to the bottom plate 410 is recessed, so as to form the first groove 453B. At least one side of the first groove 453B is open, and the first groove 453B is proximate to the first side 451 of the second air guide plate 450B. The first groove 453B is configured to provide escape space for the movement of the second air guide plate 450B. For example, in a case where the first air guide assembly 400 includes the plurality of second air guide plates 450B, in two adjacent second air guide plates 450B, the second side 452 of one second air guide plate 450B is located in the first groove 453B of the other second air guide plate 450B, so as to prevent the two adjacent second air guide plates 450B from interfering with each other when the two adjacent second air guide plates 450B are moving. Moreover, by providing the first groove 453B, the two adjacent second air guide plates 450B may partially overlap with each other, so as to avoid gaps between the two adjacent second air guide plates 450B that may affect the air guide effect.

Figure 9K:
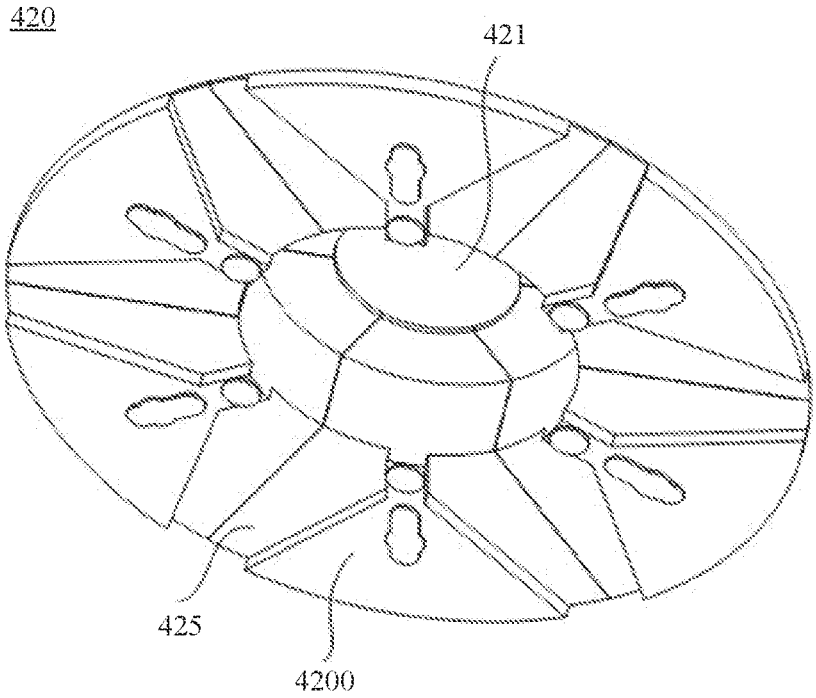
FIG. 9K is a diagram showing a structure of an air guide portion, in accordance with some embodiments.
Figure 9L:
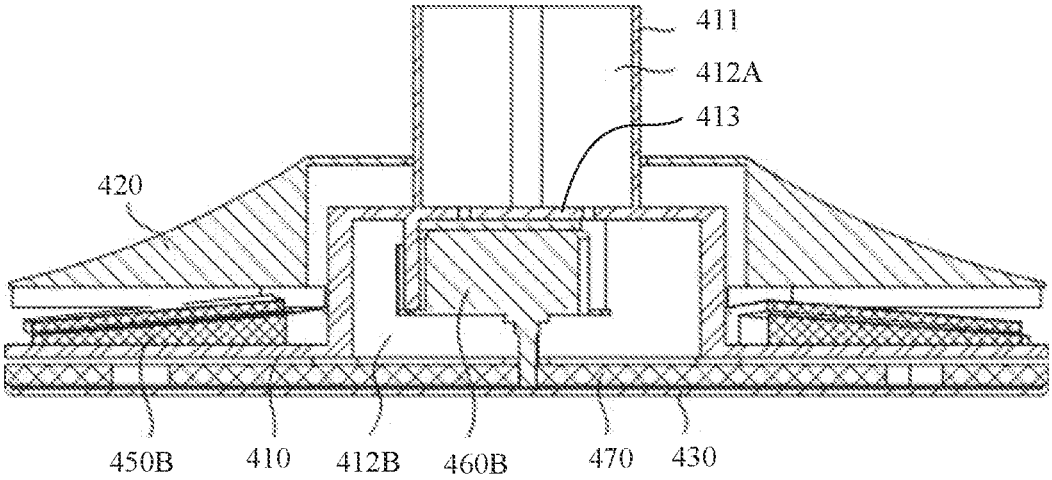
FIG. 9L is a sectional view of a first air guide assembly (the second air guide plates being in a retracting state), in accordance with some embodiments.

In some embodiments, as shown in FIG. 9K, the air guide portion 420 includes an air guide portion body 4200 and a fourth groove 425. The fourth groove 425 is located on a side of the air guide portion body 4200 proximate to the bottom plate 410, and the fourth groove 425 is configured to provide space for the movement of the second air guide plates 450B. It will be noted that, in a case where the first air guide assembly 400 includes the second air guide plates 450B, a structure of the air guide portion 420 corresponding to the second air guide plates 450B is similar to that of the air guide portion 420 corresponding to the first air guide plates 450A, except that the air guide portion 420 corresponding to the second air guide plates 450B may not include the first openings 422 and the support rib 423.

In some embodiments, as shown in FIG. 9L, a second cavity 412B is provided in the connecting portion 411, and the second driving motor 460B is disposed in the second cavity 412B. The second cavity 412B is located on a side (e.g., the lower side) of the first cavity 412A proximate to the bottom plate 410, and the second cavity 412B is separated from the first cavity 412A by the bottom portion 413 of the first cavity 412A. A side (e.g., the lower side) of the second cavity 412B proximate to the bottom plate 410 is open, so as to be conducive to installing the second driving motor 460B in the second cavity 412B.

It will be noted that, in a case where the first air guide assembly 400 includes the decorative cover 430, since the driving plate 470 is located between the decorative cover 430 and the air guide portion 420, in a case where the decorative cover 430 is connected to the air guide portion 420, the decorative cover 430 may prevent the second air guide plates 450B from stretching out or retracting. In order to solve the above problem, in some embodiments, the decorative cover 430 may be buckled with the driving plate 470 or be fixedly connected with the driving plate 470 through other manners.

In the first blowing mode, the second blowing mode or the third blowing mode, the second air guide plates 450B may be movable, so as to further adjust the flow direction of the air in each blowing mode.

In addition, the second air guide plates 450B may stretch out or retract while at least one of the vertical movement or the tilting movement of the first air guide assembly 400 is performed, so as to achieve different blowing modes.

Figure 13A:
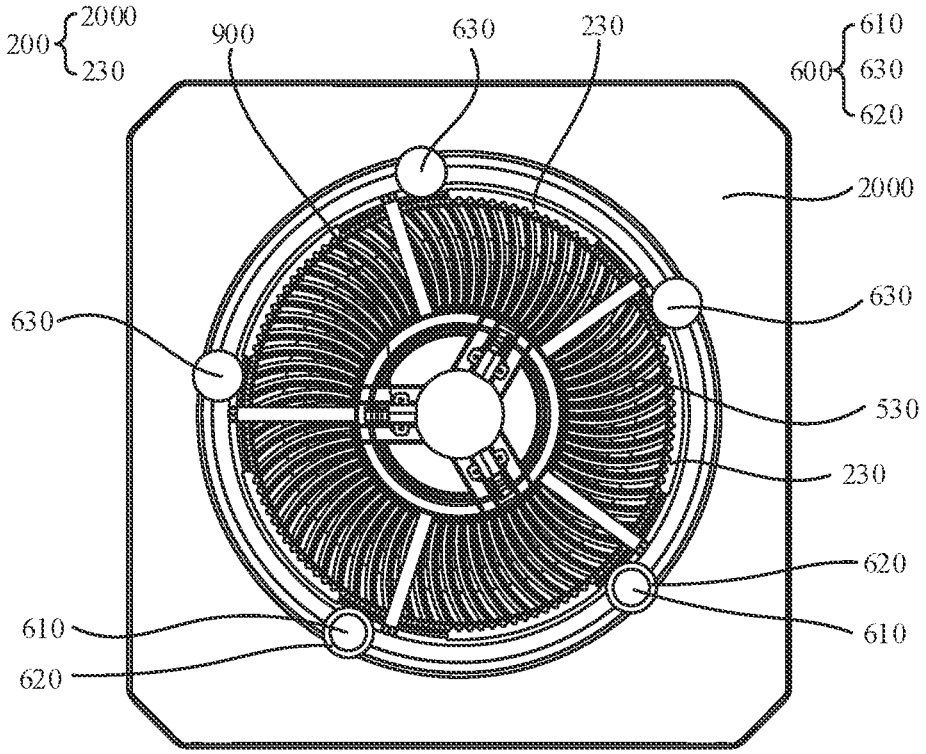
FIG. 13A is an assembly diagram of a second air guide assembly, a second driving assembly, and a panel, in accordance with some embodiments.

In some embodiments, the second air guide assembly 500 is configured to make the air flowing out from the first air outlet 210 to become turbulent and flow to the first air guide assembly 400 after the air flowing out from the first air outlet 210 has passed through the second air guide assembly 500. As shown in FIG. 1 and FIGS. 13A to 13C, the second air guide assembly 500 is located on a side (e.g., the upper side) of the first air guide assembly 400 proximate to the housing 100, so as to avoid interfering with the first air guide assembly 400. As shown in FIG. 13A, the air conditioner indoor unit 1000 further includes a second driving assembly 600. The second driving assembly 600 may drive the second air guide assembly 500 to rotate, so as to make the air flowing out from the second air outlet 440 become gentle.

Figure 13B:
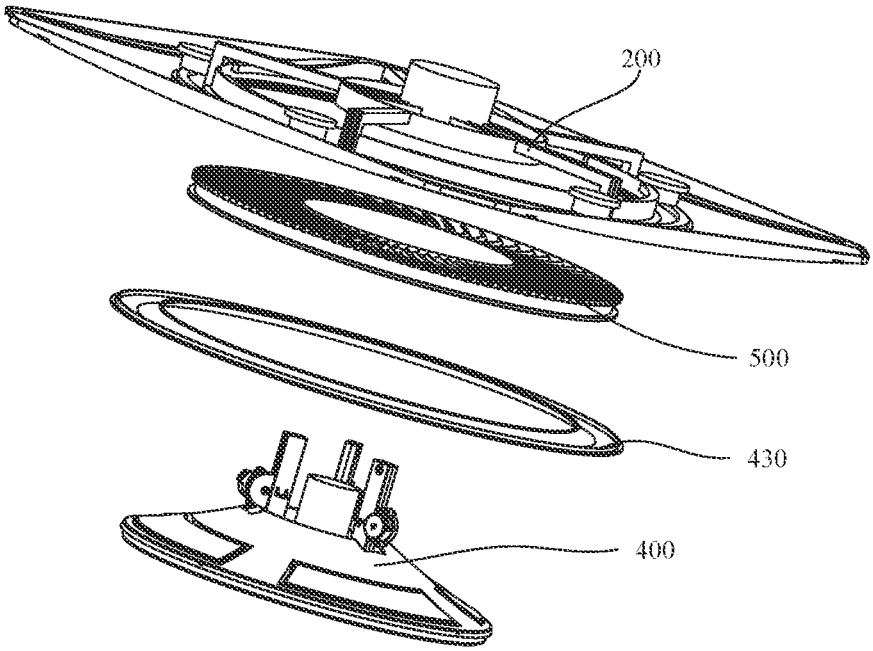
FIG. 13B is an exploded view of the structure shown in FIG. 13A.
Figure 13C:
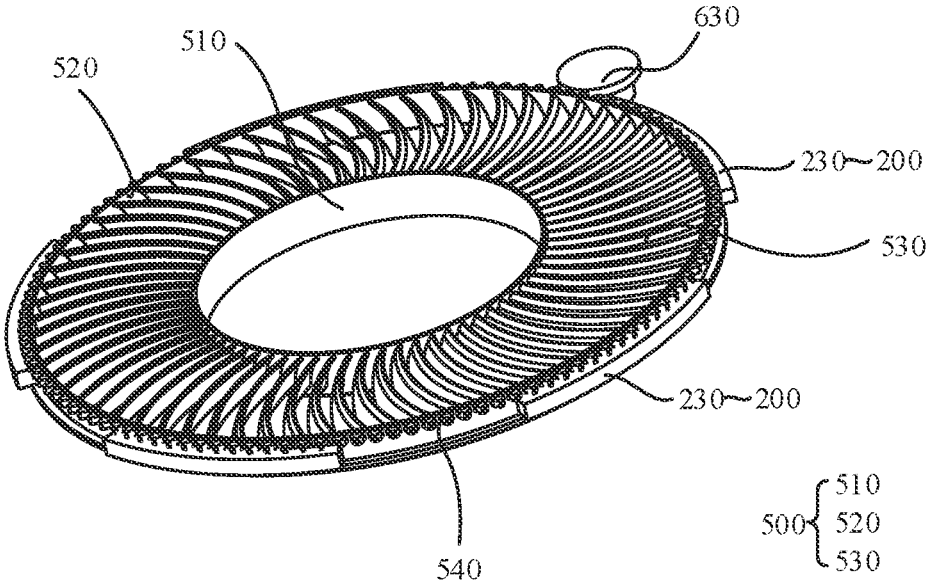
FIG. 13C is a diagram showing a structure of the second air guide assembly in FIG. 13B.

As shown in FIG. 13C, the second air guide assembly 500 includes an inner plate 510, an outer plate 520, and a plurality of blades 530. The outer plate 520 is disposed around the inner plate 510, and the outer plate 520 and the inner plate 510 are arranged at an interval. The plurality of blades 530 are disposed between the inner plate 510 and the outer plate 520, and there is a gap between two adjacent blades 530, so that the air may pass through the second air guide assembly 500 through the gap. The inner plate 510 and the outer plate 520 each are in a shape of a ring, and the blades 530 each are in a shape of an arc, so that the gap between adjacent blades 530 is also in a shape of an arc, so as to increase a size of the gap for the air to flow through.

In some embodiments, the blades 530 are rotatable. In this way, the blades 530 may rotate within an angle range due to the action of the flowing air, so as to simulate the natural wind and make the air flowing out from the second air outlet 440 gentle.

In some embodiments, the inner plate 510 and the outer plate 520 are located in a same plane, and the plane is parallel to the horizontal plane. The plurality of blades 530 may be inclined relative to the plane (e.g., the horizontal plane), and the plurality of blades 530 have a same inclined direction. By inclining the plurality of blades 530, the flowing air may blow to surfaces of the blades 530, so as to provide power to the blades 530, so that the blades 530 may rotate due to the action of the flowing air.

In some embodiments, the second air guide assembly 500 is located on a side (e.g., the upper side) of the panel 200 proximate to the housing 100, and there is a gap between the second air guide assembly 500 and the panel 200. For example, the second air guide assembly 500 has a first induction portion, and the panel 200 has a second induction portion. The first induction portion and the second induction portion are magnetic components. According to the principle that magnets of same polarity repel each other, the first induction portion and the second induction portion may repel each other, so as to form the gap between the second air guide assembly 500 and the panel 200. In this way, the second air guide assembly 500 and the panel 200 may be arranged at an interval, so as to prevent the panel 200 from interfering the rotation of the second air guide assembly 500, thereby reducing the wear of the second air guide assembly 500 and prolonging the service life of the second air guide assembly 500.

In some embodiments, as shown in FIGS. 13A to 13C, the second driving assembly 600 includes a fourth driving motor 610 and a driving gear 620. The driving gear 620 is connected with an output end of the fourth driving motor 610. The second driving assembly 600 is disposed on the panel 200. For example, a shaft of the driving gear 620 and the fourth driving motor 610 each are fixed on the panel 200. The second air guide assembly 500 further includes a plurality of driven teeth 540. The plurality of driven teeth 540 are arranged at intervals on an outer wall of the outer plate 520, and the driving gear 620 engages with the plurality of driven teeth 540. In this way, after the fourth driving motor 610 is started, the fourth driving motor 610 drives the driving gear 620 to rotate, and the driving gear 620 may drive the second air guide assembly 500 to rotate.

During the rotation of the second air guide assembly 500, the flowing air at the first air outlet 210 may continue to pass through the rotating blades 530, and the blades 530 cut the passing air to make the air flowing out from the second air outlet 440 gentle, so as to achieve a uniform air supply.

During the rotation of the second air guide assembly 500, the second air guide assembly 500 may tilt due to the action of the driving gear 620, which causes a central axis of the second air guide assembly 500 to deviate from the central axis of the panel 200. Therefore, in some embodiments, as shown in FIGS. 13A and 13C, the second driving assembly 600 further includes a plurality of driven gears 630, so as to improve the stability of the second air guide assembly 500. Shafts of the plurality of driven gears 630 each are fixed on the panel 200. The plurality of driven gears 630 are disposed around the second air guide assembly 500. The plurality of driven gears 630 engage with the plurality of driven teeth 540 of the second air guide assembly 500.

When the driving gear 620 applies force to the second air guide assembly 500 from one direction along a radial direction of the driving gear 620, the driven gears 630 each may apply force to the second air guide assembly 500 from another direction along a radial direction of the driven gear 630, so as to avoid the displacement of the second air guide assembly 500 and improve the stability of the second air guide assembly 500 when the second air guide assembly 500 is working.

In some embodiments, as shown in FIG. 13A, the second driving assembly 600 includes two driving gears 620 and three driven gears 630, and the two driving gears 620 and three driven gears 630 are arranged at equal intervals around the second driving assembly 600. It will be noted that, in FIG. 13A, the two driving gears 620 correspond to two fourth driving motors 610 respectively.

In addition, in some embodiments, as shown in FIGS. 13A and 13C, the panel 200 further includes a panel body 2000 and a plurality of protective plates 230. The plurality of protective plates 230 are fixed on a surface of the panel body 2000 facing the second air guide assembly 500. The plurality of protective plates 230 each are in a shape of an arc, and the protective plates 230 each may be located between two adjacent driving gears 620, between two adjacent driven gears 630, or between the driving gear 620 and the driven gear 630 that are adjacent. In this way, it is possible to prevent the second air guide assembly 500 from falling on the first air guide assembly 400 or directly falling on the ground due to the failure of the first induction portion and the second induction portion.

When the air conditioner is operating in a cooling mode, a heat exchanger in an air conditioner outdoor unit operates as a condenser, and the heat exchanger in the air conditioner indoor unit 1000 operates as an evaporator. The condenser dissipates heat of the refrigerant in the condenser to outdoor air, and the refrigerant in the evaporator absorbs heat of the indoor air to reduce the indoor temperature, so that a temperature of the condenser is high and a temperature of the evaporator is low. In a case where the temperature of the evaporator is lower than the indoor temperature, water vapor in the indoor air condenses into liquid water on a surface of the evaporator. Especially in a case where humidity of the air in summer is high and the indoor air contains a lot of water vapor, condensed water is easy to be formed on the surface of the evaporator. Similarly, in a case where the air conditioner is operating in a dehumidification mode (especially a cooling dehumidification mode), condensed water is also easy to be generated in the air conditioner indoor unit 1000. Therefore, it is required that the air conditioner indoor unit 1000 is provided with a water pan, so as to collect the condensed water generated when the air conditioner indoor unit 1000 is operated and discharge the condensed water from the air conditioner indoor unit 1000.

Figure 14A:
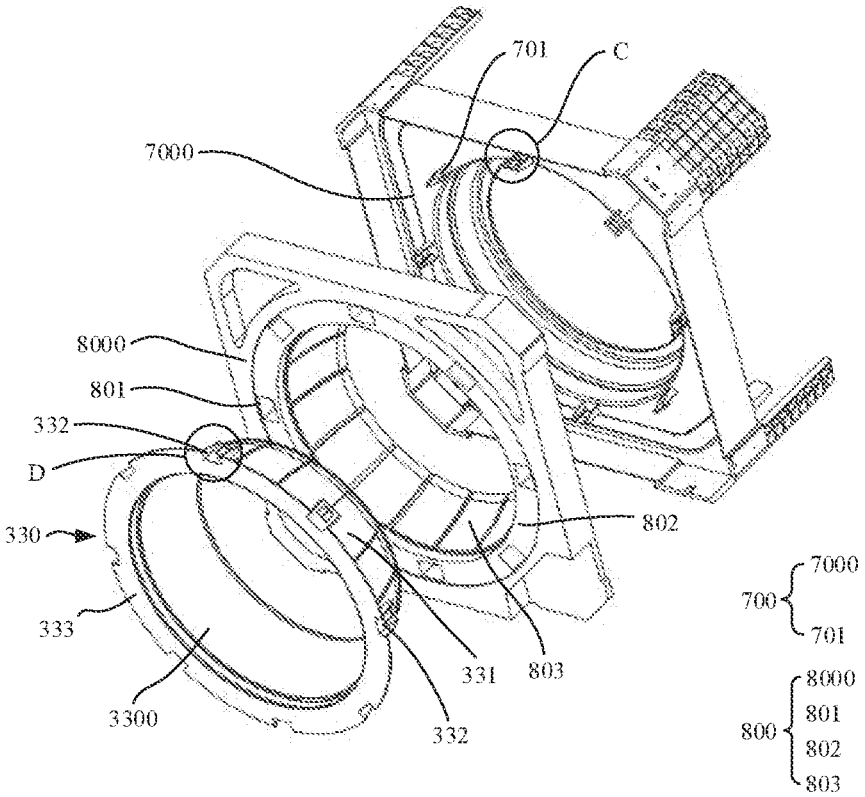
FIG. 14A is an assembly diagram of an air guide portion, a water pan, and a heat-retaining assembly, in accordance with some embodiments.
Figure 14B:
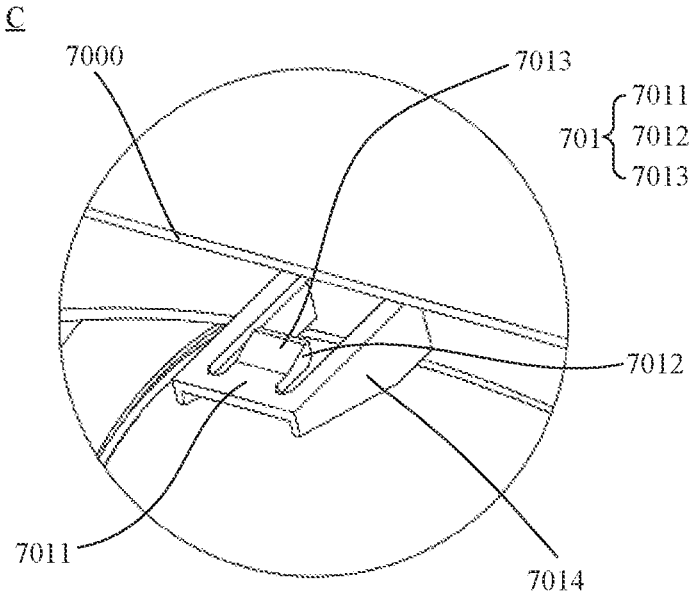
FIG. 14B is a partial enlarged view of the circle C in FIG. 14A.
Figure 14C:
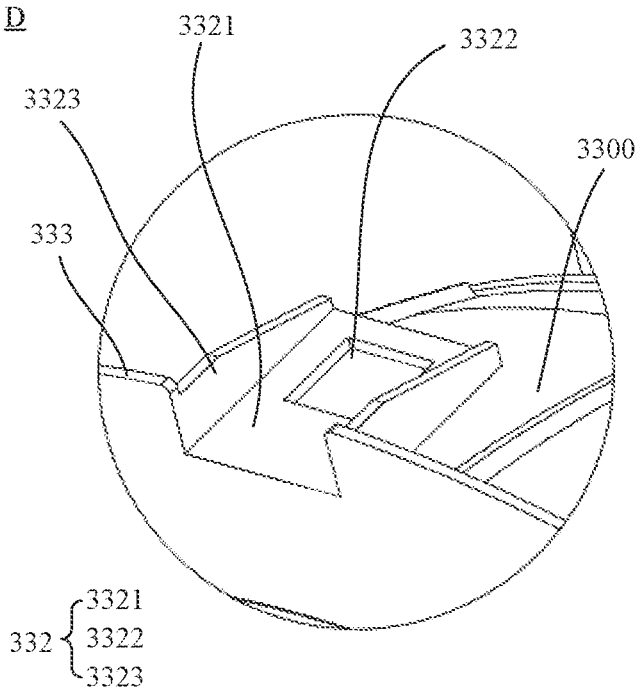
FIG. 14C is a partial enlarged view of the circle D in FIG. 14A.

In some embodiments, as shown in FIGS. 14A to 14C, the air conditioner indoor unit 1000 further includes a water pan 700 and a heat-retaining assembly 800, and the heat-retaining assembly 800 is located between the water pan 700 and the fan assembly 300. The water pan 700 is configured to accommodate the condensed water generated when the air conditioner indoor unit 1000 is operated, and the heat-retaining assembly 800 is configured to retain heat of the air conditioner indoor unit 1000.

The water pan 700 is located outside the fan shroud 330, and the heat-retaining assembly 800 is located between the fan shroud 330 and the water pan 700. The fan shroud 330 has an air guide surface 331 (referring to FIG. 14A), and the air guide surface 331 is an arc surface. The heat-retaining assembly 800 has an inner wall 803 corresponding to a shape of the air guide surface 331. For example, a curvature of the inner wall 803 of the heat-retaining assembly 800 is the same as a curvature of the air guide surface 331.

In some embodiments, as shown in FIGS. 14A to 14C, the fan shroud 330 includes a shroud body 3300 and a plurality of first locking portions 332. The plurality of first locking portions 332 are circumferentially arranged around the shroud body 3300. The water pan 700 includes a pan body 7000 and a plurality of second locking portions 701, and the plurality of second locking portions 701 are arranged on a side of the pan body 7000 proximate to the heat-retaining assembly 800. The plurality of second locking portions 701 respectively correspond to the plurality of first locking portions 332, and the second locking portion 701 is connected to the corresponding first locking portion 332.

In some embodiments, as shown in FIGS. 14A and 14C, the fan shroud 330 further includes a flange 333. The flange 333 is disposed on a side (e.g., the outer side) of the shroud body 3300 proximate to the heat-retaining assembly 800, and is located at an end portion (e.g., the bottom end) of the shroud body 3300 away from the fan assembly 300. The plurality of first locking portions 332 are arranged at equal intervals on the flange 333 along the circumferential direction. The flange 333 is used to carry the first locking portions 332 and is connected with the heat-retaining assembly 800, so as to limit the heat-retaining assembly 800.

In a case where the first locking portions 332 are connected to the second locking portions 701, the heat-retaining assembly 800 is clamped between the fan shroud 330 and the water pan 700, which is conducive to improving the stability and firmness of the connection between the fan shroud 330 and the heat-retaining assembly 800. For example, the heat-retaining assembly 800 has a second via hole 801, and the first locking portion 332 and the second locking portion 701 are connected in the second via hole 801.

In some embodiments, the first locking portion 332 and the second locking portion 701 may be fixedly connected by means of a screw or may be snap-fitted with each other. In a case where the first locking portion 332 is fixedly connected to the second locking portion 701 by means of a screw, the screw passes through the first locking portion 332 and is fastened on the second locking portion 701.

In a case where the first locking portion 332 is snap-fitted with the second locking portion 701, as shown in FIG. 14C, the first locking portion 332 includes a first locking plate 3321 and a second opening 3322 disposed on the first locking plate 3321. The first locking plate 3321 extends from the flange 333 in a direction away from the flange 333 (e.g., extends toward a direction proximate to the water pan 700). As shown in FIG. 14B, the second locking portion 701 includes a second locking plate 7011 and a locking block 7012 disposed on the second locking plate 7011. The second locking plate 7011 extends from a surface of the water pan 700 in a direction away from the water pan 700 (e.g., extends toward a direction proximate to the fan shroud 330). The locking block 7012 is disposed on a side (e.g., the outer side) of the second locking plate 7011 away from the fan assembly 300, and the locking block 7012 protrudes in a direction away from the fan assembly 300. The locking block 7012 is snapped into the second opening 3322, so as to connect the first locking portion 332 and the second locking portion 701.

During a process that the first locking portion 332 is connected to the second locking portion 701, in order to make the first locking portion 332 be connected with the second locking portion 701 smoothly, and the second locking portion 701 further includes an inclined surface 7013. The inclined surface 7013 is a surface of the locking block 7012 away from the fan assembly 300, and in a direction of from the heat-retaining assembly 800 to the water pan 700, the inclined surface 7013 extends in a direction away from the fan assembly 300. In this way, when the first locking portion 332 is moving to the second locking portion 701, the locking block 7012 is pressed in a direction proximate to the fan assembly 300 due to the action of the inclined surface 7013, so as to be helpful for the first locking portion 332 to move to the outside of the second locking portion 701.

When the second opening 3322 of the first locking portion 332 is opposite to the locking block 7012 of the second locking portion 701, the locking block 7012 is no longer pressed by the first locking portion 332, so that the locking block 7012 is reset and enters the second opening 3322, so as to achieve the connection between the first locking portion 332 and the second locking portion 701.

In some embodiments, as shown in FIG. 14C, the first locking portion 332 further includes a first reinforcing rib 3323. The first reinforcing rib 3323 is arranged on at least one of two sides of the first locking plate 3321, and one end of the first reinforcing rib 3323 is connected to the flange 333, so as to enhance the structural strength of the first locking plate 3321, thereby improving the stability of the first locking portion 332.

Similarly, as shown in FIG. 14B, the second locking portion 701 further includes a second reinforcing rib 7014. The second reinforcing rib 7014 is disposed on at least one of two sides of the second locking plate 7011 and connected with the pan body 7000.

In some embodiments, as shown in FIG. 14A, the heat-retaining assembly 800 further includes a heat-retaining body 8000 and a fifth groove 802. The fifth groove 802 is in a shape of a ring, and the fifth groove 802 is disposed on a side of the heat-retaining body 8000 away from the water pan 700 and is recessed in a direction proximate to the water pan 700. The plurality of the second via holes 801 are arranged at equal intervals in the fifth groove 802. The flange 333 of the fan shroud 330 is located in the fifth groove 802, and a size of the fifth groove 802 is the same as a size of the flange 333, so as to facilitate the positioning of the fan shroud 330 during the installation process of the fan shroud 330 and improve the installation speed, so that the heat-retaining assembly 800 may be firmly clamped between the fan shroud 330 and the water pan 700.

The fan shroud 330, the water pan 700 and the heat-retaining assembly 800 each have a simple installation structure and are easy to be fabricated, which improves the processing speed and installation efficiency. Moreover, the connection among the fan shroud 330, the water pan 700, and the heat-retaining assembly 800 is stable and the connection strength is high.

Figure 15:
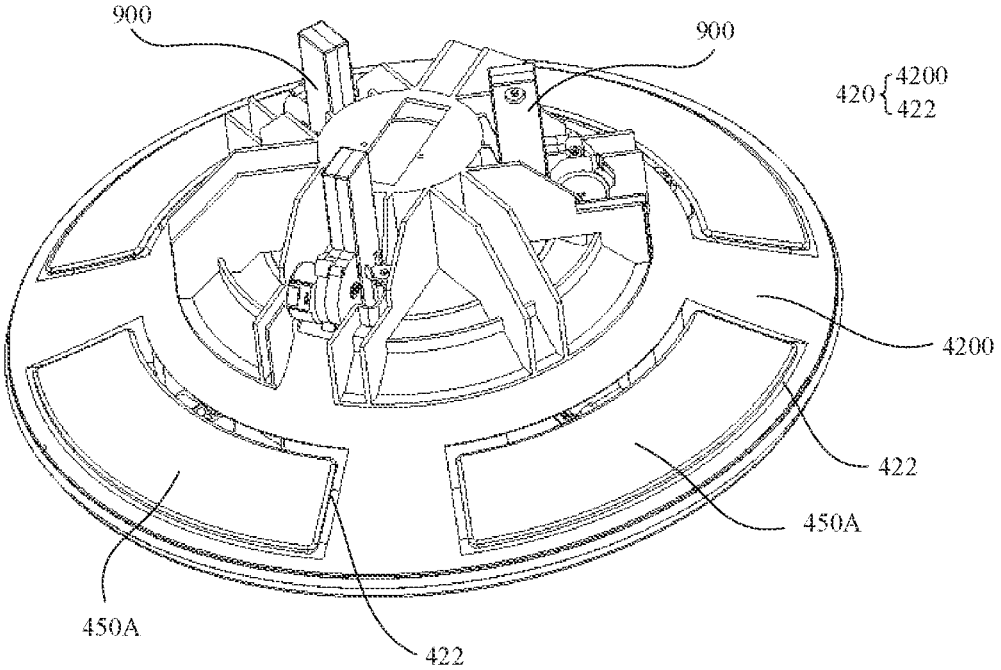
FIG. 15 is a diagram showing a structure of yet another first air guide assembly assembled with a panel through a first driving assembly, in accordance with some embodiments.

In the above description of the embodiments, specific features, structures, materials, or characteristics may be combined in any suitable manner in any one or more embodiments or examples. For example, the first air guide assembly 400 shown in FIGS. 10A to 10C does not include the air guide plate (e.g., the first air guide plate 450A or the second air guide plate 450B). However, as shown in FIG. 15, the first air guide assembly 400 shown in FIGS. 10A and 10B may also be provided with the first air guide plate 450A or the second air guide plate 450B, so as to adjust the flow direction of the air flowing out from the second air outlet 440 through the first air guide plate 450A or the second air guide plate 450B, thereby further achieving the adjustment of the air supply angle. It will be noted that, for the relevant driving structure and the relevant installation structure corresponding to the first air guide plate 450A or the second air guide plate 450B, reference may be made to the relevant description above, and details will not be repeated here.

A person skilled in the art will understand that the scope of disclosure in the present disclosure is not limited to specific embodiments discussed above and may modify and substitute some elements of the embodiments without departing from the spirits of this application. The scope of this application is limited by the appended claims.

What is claimed is:

1. An air conditioner indoor unit, comprising:

a housing having an inner cavity, a side of the inner cavity being open to constitute an opening;

a panel disposed at the opening of the housing, and the panel including a first air outlet;

a fan assembly located in the inner cavity of the housing;

a first air guide assembly located on a side of the panel away from the housing, a second air outlet being provided between an edge of the first air guide assembly and an edge of the first air outlet, and the second air outlet being a portion of the first air outlet; and at least one first driving assembly, wherein an end of the at least one first driving assembly is fixedly connected to the panel, and another end of the at least one first driving assembly is fixedly connected to the first air guide assembly, and the at least one first driving assembly is configured to drive the first air guide assembly to move relative to the panel, so as to change a size of the second air outlet to adjust a flow direction of air flowing out from the second air outlet;

wherein the first air guide assembly includes:

an air guide portion configured to guide air from the first air outlet, an edge of the air guide portion being the edge of the first air guide assembly, and the air guide portion having a first via hole; and the air guide portion including:

an air guide portion body;

a first opening penetrating the air guide portion body; and a support rib disposed on a side of the air guide portion body proximate to the bottom plate and abutting against the bottom plate;

a bottom plate located on a side of the air guide portion away from the housing, the bottom plate including a connecting portion, the connecting portion extending from the bottom plate in a direction away from the bottom plate, and the connecting portion having a first cavity; and the another end of the at least one first driving assembly extending into the first cavity through the first via hole and being fixedly connected at a bottom portion of the first cavity, and the end of the at least one first driving assembly being fixedly connected to the panel;

a first air guide plate located in the first opening, and the first air guide plate is configured to move in a direction different from a moving direction of the bottom plate of the first air guide assembly, so as to change at least a portion of the second air outlet to adjust the flow direction of part or all of the air flowing out from the second air outlet; and a first driving motor connected with the first air guide plate, the first driving motor being configured to drive the first air guide plate to swing relative to the bottom plate, so as to adjust the flow direction of the air flowing out from the second air outlet.

2. The air conditioner indoor unit according to claim 1, wherein the first air guide plate includes:

a connecting rib; and a connecting hole disposed in the connecting rib;

the bottom plate includes a mounting column, the first driving motor is fixedly disposed on the mounting column, and a motor shaft of the first driving motor is connected to the connecting hole.

3. The air conditioner indoor unit according to claim 1, wherein the panel includes a mounting portion, the mounting portion includes a mounting cavity, the connecting portion of the bottom plate extends into the mounting cavity, and the connecting portion is slidably connected with the mounting portion.

4. The air conditioner indoor unit according to claim 1, wherein a first driving assembly of the at least one first driving assembly includes:

a driving member, and the driving member including:

a shell fixedly connected with the panel;

a rotating gear located in a cavity of the shell;

a third driving motor located in the cavity of the shell and fixedly connected to the rotating gear, the third driving motor being configured to drive the rotating gear to rotate; and a rack portion located in the cavity of the shell, the rack portion being configured to move relative to the shell, so that the first driving assembly drives the first air guide assembly to move in a direction proximate to or away from the panel, the rack portion including a rack segment, and the rack segment engaging with the rotating gear, so that the rack portion is driven to move along an inner wall of the shell through the rotating gear; and a fixing member, the fixing member including a connecting plate, the connecting plate being fixedly connected with the rack portion, and the connecting plate being fixedly connected with the first air guide assembly.

5. The air conditioner indoor unit according to claim 4, wherein the first driving assembly further includes a rotating member, the rotating member is located between the driving member and the fixing member, and the rotating member is configured to make the first air guide assembly rotatable relative to the rotating member; and the at least one first driving assembly includes a plurality of first driving assemblies, and the plurality of first driving assemblies are configured to move asynchronously to drive the first air guide assembly, so as to perform a tilting movement relative to the panel.

6. The air conditioner indoor unit according to claim 4, wherein the driving member further includes a rolling wheel, a first portion of the rolling wheel is located in a cavity of the rack portion, and a second portion of the rolling wheel is located outside the cavity of the rack portion, and the second portion of the rolling wheel exposed from the rack portion is in rolling contact with the inner wall of the shell.

7. The air conditioner indoor unit according to claim 1, further comprising a second air guide assembly, wherein the second air guide assembly is located on a side of the panel proximate to the housing, and a gap is provided between the second air guide assembly and the panel, the second air guide assembly is configured to make air flowing out from the first air outlet to become turbulence and flow to the first air guide assembly after the air flowing out from the first air outlet has passed through the second air guide assembly.

8. The air conditioner indoor unit according to claim 7, wherein the second air guide assembly includes:

an inner plate;

an outer plate disposed around the inner plate, and the outer plate and the inner plate being arranged at an interval; and a plurality of blades disposed between the inner plate and the outer plate, a gap is provided between two adjacent blades of the plurality of blades, so that the air flowing out from the first air outlet passes through the gap to the first air guide assembly.

9. The air conditioner indoor unit according to claim 8, further comprising a second driving assembly, wherein the second driving assembly includes:

a fourth driving motor disposed on the panel; and a driving gear connected to an output end of the fourth driving motor, a shaft of the driving gear being fixed on the panel;

wherein the second air guide assembly further includes a plurality of driven teeth, the plurality of driven teeth are arranged on an outer side wall of the outer plate, and the plurality of driven teeth engage with the driving gear, the fourth driving motor is configured to drive the driving gear to rotate, so as to drive the second air guide assembly to rotate.

10. The air conditioner indoor unit according to claim 9, wherein the second driving assembly further includes a plurality of driven gears, shafts of the plurality of driven gears each are fixed on the panel, and the plurality of driven gears are arranged around the second air guide assembly, the plurality of driven gears engage with the plurality of driven teeth, and each driven gear of the plurality of driven gears is configured to at least partially counteract force of the driving gear on the second air guide assembly along a radial direction of the driven gear.

11. The air conditioner indoor unit according to claim 1, wherein the fan assembly includes a fan shroud, and the fan shroud includes:

a shroud body; and a plurality of first locking portions disposed around the fan shroud in a circumferential direction and arranged at equal intervals;

the air conditioner indoor unit further includes:

a water pan located outside the fan shroud, the water pan including:

a pan body; and a plurality of second locking portions corresponding to the plurality of first locking portions, each second locking portion being connected to a corresponding first locking portion; and a heat-retaining assembly located between the fan shroud and the water pan.

12. The air conditioner indoor unit according to claim 11, wherein each first locking portion includes:

a first locking plate; and a second opening disposed on the first locking plate;

the second locking portion includes:

a second locking plate; and a locking block disposed on a side of the second locking plate away from the fan assembly and protruding in a direction away from the fan assembly, the locking block being snapped into the second opening, so that the first locking portion is connected to the second locking portion.

13. The air conditioner indoor unit according to claim 12, wherein the second locking portion further includes an inclined surface, the inclined surface is a surface of the locking block away from the fan assembly, and in a direction of from the heat-retaining assembly to the water pan, the inclined surface extends in the direction away from the fan assembly.

14. An air conditioner indoor unit, comprising:

a housing having an inner cavity, a side of the inner cavity being open to constitute an opening;

a panel disposed at the opening of the housing, and the panel including a first air outlet;

a fan assembly located in the inner cavity of the housing;

a first air guide assembly located on a side of the panel away from the housing, a second air outlet being provided between an edge of the first air guide assembly and an edge of the first air outlet, and the second air outlet being a portion of the first air outlet; and at least one first driving assembly, wherein an end of the at least one first driving assembly is fixedly connected to the panel, and another end of the at least one first driving assembly is fixedly connected to the first air guide assembly, and the at least one first driving assembly is configured to drive the first air guide assembly to move relative to the panel, so as to change a size of the second air outlet to adjust a flow direction of air flowing out from the second air outlet;

wherein the first air guide assembly includes:

an air guide portion configured to guide air from the first air outlet, an edge of the air guide portion being the edge of the first air guide assembly, and the air guide portion having a first via hole;

a bottom plate located on a side of the air guide portion away from the housing, the bottom plate including a first slideway and a connecting portion, the connecting portion extending from the bottom plate in a direction away from the bottom plate, and the connecting portion having a first cavity; and the another end of the at least one first driving assembly extending into the first cavity through the first via hole and being fixedly connected at a bottom portion of the first cavity, and the end of the at least one first driving assembly being fixedly connected to the panel;

a driving plate including a second slideway;

at least one second air guide plate, the at least one second air guide plate is configured to move in a direction different from a moving direction of the bottom plate of the first air guide assembly, so as to change at least a portion of the second air outlet to adjust the flow direction of part or all of the air flowing out from the second air outlet, and a second air guide plate of the at least one second air guide plate including:

a first guide protrusion slidably disposed in the first slideway; and a second guide protrusion slidably disposed in the second slideway; and a second driving motor connected to the driving plate, and the second driving motor being configured to drive the driving plate to rotate, so that the driving plate drives the at least one second air guide plate to stretch out or retract along a radial direction of the bottom plate relative to the air guide portion.

15. The air conditioner indoor unit according to claim 14, wherein the at least one second air guide plate includes a plurality of second air guide plates, at least one of the plurality of second air guide plates includes a first groove, and a portion of a surface of the at least one of the plurality of second air guide plates proximate to the bottom plate is recessed, so as to constitute the first groove, the first groove is configured to provide escape space for movement of the at least one of the plurality of second air guide plates; and in two adjacent second air guide plates, an end of one second air guide plate is located in the first groove of another second air guide plate, so that the two adjacent second air guide plates partially overlap with each other.

16. The air conditioner indoor unit according to claim 14, wherein the connecting portion is provided with a second cavity, the second cavity is located on a side of the first cavity proximate to the bottom plate, and the second cavity is separated from the first cavity through the bottom portion of the first cavity, a side of the second cavity proximate to the bottom plate is open, so that the second driving motor is located in the second cavity.

17. An air conditioner indoor unit, comprising:

a housing having an inner cavity, a side of the inner cavity being open to constitute an opening;

a panel disposed at the opening of the housing, the panel including a first air outlet;

a fan assembly located in the inner cavity of the housing;

a first air guide assembly located on a side of the panel away from the housing, a second air outlet being provided between an edge of the first air guide assembly and an edge of the first air outlet, the second air outlet being a portion of the first air outlet; and a plurality of first driving assemblies, an end of at least one first driving assembly of the plurality of first driving assemblies being fixedly connected to the panel, and another end of the at least one first driving assembly being fixedly connected to the first air guide assembly; and a first driving assembly of the at least one first driving assembly including a driving member, a fixing member and a rotating member, the rotating member being located between the driving member and the fixing member, and the rotating member being configured to make the first air guide assembly rotatable relative to the rotating member;

wherein the plurality of first driving assemblies are configured to move synchronously, so as to drive the first air guide assembly to move in a direction away from or proximate to the panel, or to move asynchronously to drive the first air guide assembly to perform a tilting movement relative to the panel, so as to change a size of the second air outlet to adjust a flow direction of air flowing out from the second air outlet;

wherein the driving member includes:

a shell fixedly connected with the panel;

a rotating gear located in a cavity of the shell;

a third driving motor located in the cavity of the shell and fixedly connected to the rotating gear, the third driving motor being configured to drive the rotating gear to rotate; and a rack portion located in the cavity of the shell, the rack portion being configured to move relative to the shell, so that the first driving assembly drives the first air guide assembly to move in the direction proximate to or away from the panel, the rack portion including a rack segment, and the rack segment engaging with the rotating gear, so that the rack portion is driven by the rotating gear to move along an inner wall of the shell;

the fixing member includes:

a connecting plate, the connecting plate being fixedly connected to the rack portion, and the connecting plate being fixedly connected to the first air guide assembly; and the rotating member includes:

a base connected with the fixing member, and the base including an accommodating cavity, and a first portion of the accommodating cavity proximate to the driving member being smaller than a second portion of the accommodating cavity away from the driving member;

a rolling ball located in the accommodating cavity and rotatable in the accommodating cavity;

a pin, an end of the pin being fixedly connected to the rolling ball, and another end of the pin being fixedly connected to the rack portion; and a limiting block disposed in the accommodating cavity and contacting with the rolling ball, so as to limit the rolling ball.

* * * * *